US006260941B1

(12) United States Patent
Su et al.

(10) Patent No.: US 6,260,941 B1
(45) **Date of Patent: *Jul. 17, 2001**

(54) ACOUSTIC AND ULTRASONIC MONITORING OF INKJET DROPLETS

(75) Inventors: Wen-Li Su, Vancouver, WA (US); Trudy L. Benjamin; Steven B. Elgee, both of Portland, OR (US); Thomas F. Uhling, Vancouever, WA (US); Bruce A. Axten, Vancouver, WA (US); Kerry J. Lundsten, Vancouver, WA (US); Xiuting C. Man, Vancouver, WA (US); Tamara L. Hahn; Michael T. Dangelo, both of San Diego, CA (US); Bryan D. Woll, Poway, CA (US); Timothy L. Weber; James W Pearson, both of Corvallis, OR (US); Iue-Shuenn Chen, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/289,481

(22) Filed: Apr. 9, 1999

Related U.S. Application Data

(63) Continuation of application No. 08/687,000, filed on Jul. 24, 1996, now Pat. No. 5,929,875.

(51) Int. Cl.[7] ..... B41J 29/393; B41J 2/165; B41J 29/38

(52) U.S. Cl. ..... 347/19; 347/23; 347/14

(58) Field of Search ..... 347/19, 23, 20, 347/14, 6, 7, 65, 87

(56) References Cited

U.S. PATENT DOCUMENTS 5,420,627 * 5/1995 Keefe et al. ..... 347/87
5,929,875 * 7/1999 Su et al. ..... 347/19

* cited by examiner

*Primary Examiner*—John E. Barlow, Jr.
*Assistant Examiner*—Charles W. Stewart, Jr.
(74) *Attorney, Agent, or Firm*—Flory L. Martin

(57) ABSTRACT

A monitoring system monitors a pressure wave developed in the surrounding ambient environment during inkjet droplet formation. The monitoring system uses either acoustic, ultrasonic, or other pressure wave monitoring mechanisms, such as a laser vibrometer, an ultrasonic transducer, or an accelerometer sensor, for instance, a microphone to detect droplet formation. One sensor is incorporated in the printhead itself, while others may be located externally. The monitoring system generates information used to determine current levels of printhead performance, to which the printer may respond by adjusting print modes, servicing the printhead, adjusting droplet formation, or by providing an early warning before an inkjet cartridge is completely empty. During printhead manufacturing, an array of such sensors may be used in quality assurance to determine printhead performance. An inkjet printing mechanism is also equipped for using this monitoring system, and a monitoring method is also provided.

33 Claims, 10 Drawing Sheets

200
Desired Query
220
Initiate Test
222
218
224
Nozzle Firing Command
226
218
228
246
Nozzle(s) Fire
230
206
232
202
Microphone Detects Firing
66
204
Analog Signal Conditioning
208
A/D Converter
210
214
246
212
216
Digital Signal Processing
218
234
236
238
240
Test Conditions & Parameters
Determine Action for Desired Query Based on Analyzed Data
246
242
Alert Operator
250
248
244
246
Printer Reactions and Adjustments
254
252
Resume Printing

ACOUSTIC AND ULTRASONIC MONITORING OF INKJET DROPLETS

CROSS REFERENCE TO RELATED APPLICATION this is a continuation of application Ser. No. 08/687,000 filed on Jul. 24, 1996, U.S. Pat. No. 5,929,875.

FIELD OF THE INVENTION

The present invention relates generally to inkjet printing mechanisms, and more particularly to a system for monitoring a pressure wave developed in the surrounding ambient environment during the process of inkjet droplet formation. The system uses the pressure wave information to determine current levels of printhead performance, and if required, the system then adjusts the print routine, services the printhead, or alerts an operator, for instance, that an inkjet cartridge is nearly empty.

BACKGROUND OF THE INVENTION

Inkjet printing mechanisms use cartridges, often called "pens," which shoot drops of liquid colorant, referred to generally herein as "ink," onto a page. Each pen has a printhead formed with very small, pin-hole-sized nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization or firing chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for servicing and maintenance. For storage, or during non-printing periods, the service stations usually include a capping system which hermetically seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with this non-image producing waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide faster drying, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Besides merely forcing clogs out of the nozzles, spitting also heats the ink near the nozzles, which decreases the ink viscosity and assists in dissolving ink clogs. Spitting to clear the nozzles becomes even more important when using pigment based inks, because the higher solids content contributes to the clogging problem more than the earlier dye based inks.

The pen body may serve as an ink containment reservoir that protects the ink from evaporation and holds the ink so it does not leak or drool from the nozzles, Ink leakage is prevented using a force known as "backpressure," which is provided by the ink containment system. Desired backpressure levels may be obtained using various types of pen body designs, such as resilient bladder designs, spring-bag designs, and foam-based designs.

To maintain reliability of the inkjet printing mechanism during operation, it would be helpful to have advanced warning for an operator as to when the ink level in a cartridge is getting low. This would allow an operator to procure a fresh inkjet cartridge before the one in use is completely empty. If the cartridge is refillable, an early warning would allow an operator to replenish the ink supply before the pen is dry-fired. Dry-firing an inkjet cartridge when empty may cause permanent damage to the printhead by overheating the resistive heater elements, causing the resistors to burnout.

A variety of solutions have been proposed for monitoring the level of ink within inkjet cartridges, with many incorporating measuring devices inside the cartridge. For example, several mechanical devices have been proposed to determine when the ink supply falls below a predetermined level. One system uses a ball check valve within an ink bag to interrupt ink flow when the pen is nearly empty. Unfortunately, this system has no early warning capability and it may abruptly interrupt a printing job when a certain level of ink is reached.

Other earlier ink level monitoring systems kept a running count of the number of drops fired, which worked well until cartridges were exchanged. Unfortunately, these drop counting systems had no way of determining whether a new or a partially used cartridge was installed, so they failed to detect upcoming empty conditions for the partially used cartridges. Several more sophisticated detection systems have been devised, based upon measuring printhead temperature changes after spitting specific amounts of ink into the spittoon. These temperature monitoring systems were slow to use, and they wasted ink that could otherwise have been used for printing. Other systems have been proposed using specially designed nozzles which are more sensitive to changes in the ink reservoir backpressure than the remaining nozzles, with these backpressure changes indicating ink depletion.

In operating an inkjet printing mechanism, it would be helpful to provide feedback to a print controller, such as a printer driver residing in an on-board microprocessor and/or in the host computer, as to whether or not the printhead nozzles are firing as instructed. This information would be useful to determine whether a nozzle had become clogged and required purging or spitting to clear the blockage. This information would streamline the spitting process and conserve ink because only the clogged nozzle(s) would be spit to clear the blockage. Moreover, if damaged nozzles or heating elements could be detected, then other nozzles may be substituted in the firing scheme to compensate for the damaged nozzles. Feedback as to nozzle firing could also be used to test the electro-mechanical interconnect between a replaceable inkjet cartridge and the printing mechanism. Over time, this interconnect may be contaminated with ink, interrupting the electrical connections. When this happens, it would be desirable to notify the user to clean the interconnect.

As a manufacturing quality control check, it would also be desirable to monitor nozzle performance, for instance, to verify correct nozzle-to-nozzle alignment. It would also be helpful to check for any nozzle telecentricity, that is, any lack of perpendicularly of the orifice hole through the nozzle plate relative to the plate surface. Another important feature to monitor would be nozzle directionality, that is whether a nozzle was firing at an angle other than perpendicular to the orifice plate and/or to the media.

It would also be useful to determine from merely firing ink droplets at media, what type of media was inserted into the printing mechanism, such as plain paper, glossy high-quality paper, or transparencies. This information would then allow the printer controller to adjust the print mode to correspond to the type of media in use. One desirable energy saving would be to use only the minimum "turn-on" energy required to eject ink from each of the nozzles. Using only the minimum amount of firing energy would extend printhead life by minimizing overheating of the heaters in the printhead. This minimum firing energy operation could be accomplished by providing drop feedback to the printer controller.

In the past, some inkjet printing mechanisms have detected drops using optical means. For example, one system measured the change in drop volume for a given firing temperature by firing smaller and smaller droplets until the drops could no longer be seen by the optical detector. Unfortunately, the target drop volume has decreased in newer inkjet cartridges, for instance, some droplets are now on the order of 30 picoliters. These small droplets require precise positioning of such an optical drop detector, which is difficult to implement consistently and reliably in production printing mechanisms. Other drop detect systems addressed the nozzle-to-nozzle and the printhead-to-printhead alignment issues by printing several test patterns, from which a user then selects the best pattern or compares the test pattern to a reference pattern in the instruction manual. In these visual tagging systems, the printer controller or driver then adjusts the printing mode to an optimum level that corresponds the pattern selected by the user. Another visual system uses a tab connected to the internal spring-bag reservoir to retract the tab as the pen empties, giving the user a visual ink level indicator on the pen body. Unfortunately, these visual tagging systems required user intervention or judgment, so they were not automatic or "transparent" to the user in operation.

In multi-printhead systems, such as those carrying two, three, four or more cartridges, it would also be desirable to have an automatic method of monitoring the pen-to-pen alignment. This pen-to-pen alignment could then be used to adjust the firing sequence of the nozzles to compensate for any misalignment of the pens. Pen-to-pen misalignment may be caused by improper seating within the pen carriage, or an accumulation of tolerance variations within a specific pen body and printhead of a particular cartridge. Pen-to-pen misalignment may also be caused by an accumulation of tolerance variations within a specific printer carriage which holds the cartridges.

Thus, a need exists for a system to provide inkjet droplet information to the printing mechanism controller. This information would allow the controller to respond by adjusting droplet formation or print modes, servicing the pen, or alerting the operator of a particular condition, for instance, that an inkjet cartridge is nearly empty.

SUMMARY OF THE INVENTION

According to one aspect of the present invention, an ultrasonic monitoring method of operating an inkjet printing mechanism is provided for a printing mechanism having an inkjet printhead installed therein, with the printhead having plural nozzles. The method includes the steps of applying an enabling signal to a selected nozzle of the inkjet printhead, and nonnally generating a pressure wave in response to the applying step. The method also includes the steps of ultrasonically detecting the pressure wave emitted by the selected nozzle during the generating step, and then responding to the detecting step.

According to another aspect of the invention, an inkjet printing mechanism is provided as including an inkjet printhead with plural nozzles that each normally, in response to an enabling signal, eject ink therethrough and generate a pressure wave comprising both audio and ultrasonic frequency components. The printing mechanism has an ultrasonic pressure wave sensor located to detect the ultrasonic pressure waves normally generated by the plural nozzles and in response thereto, the sensor generates a wave signal. The printing mechanism also has a controller that responds to the wave signal by generating an action signal.

According to an additional aspect of the invention, a method of monitoring the performance of an inkjet printhead having plural nozzles is provided. The method includes the steps of applying an enabling signal to a selected nozzle of the inkjet printhead, and normally generating a pressure wave in response to the applying step.

In a detecting step, the pressure wave emitted by the selected nozzle during the generating step is detected from plural locations, and in response to the detected pressure wave, a wave signal is generated from each of the plural locations. In an analyzing step, the wave signal from each of the plural locations is analyzed to determine performance of the selected nozzle.

In a further aspect of the invention, an inkjet printhead is provided for an inkjet printing mechanism that generates plural firing signals. The printhead has an ink reservoir holding a supply of ink and an orifice plate defining plural nozzles extending therethrough. An ink ejection mechanism fluidicly couples the ink reservoir to the orifice plate nozzles. The ink ejection mechanism comprises plural ink ejection chambers each responsive to at least one of the plural firing signals to normally eject ink through an associated one of the plural nozzles. An accelerometer mechanism is located adjacent to the ink Section mechanism to detect a pressure wave normally generated in response to at least one of the plural firing signals, and to generate a wave signal in response thereto.

An overall goal of the present invention is to provide an inkjet droplet formation monitoring system to generate information that may be used to determine current levels of performance, which is then used by the printer controller to optimize performance. This information may be used for a variety of other purposes, such as to give an early warning before an inkjet cartridge is completely empty, allowing an operator to refill, replace or service the cartridge.

An additional goal of the present invention is to provide a monitoring system that may be used during printhead manufacture to verify the quality of printhead performance.

Another goal of the present invention is to provide a monitoring system that may be used with any type of inkjet printhead, and to provide a special printhead that has a sensor integrally formed therein.

A further goal of the present invention is to provide an inkjet droplet formation monitoring system, as well as a printing mechanism and a method which optimizes the print quality of an image in response to this monitoring.

DETAILED DESCRIPTION OF THE PREFERRED EMBODIMENTS

Figure 1:
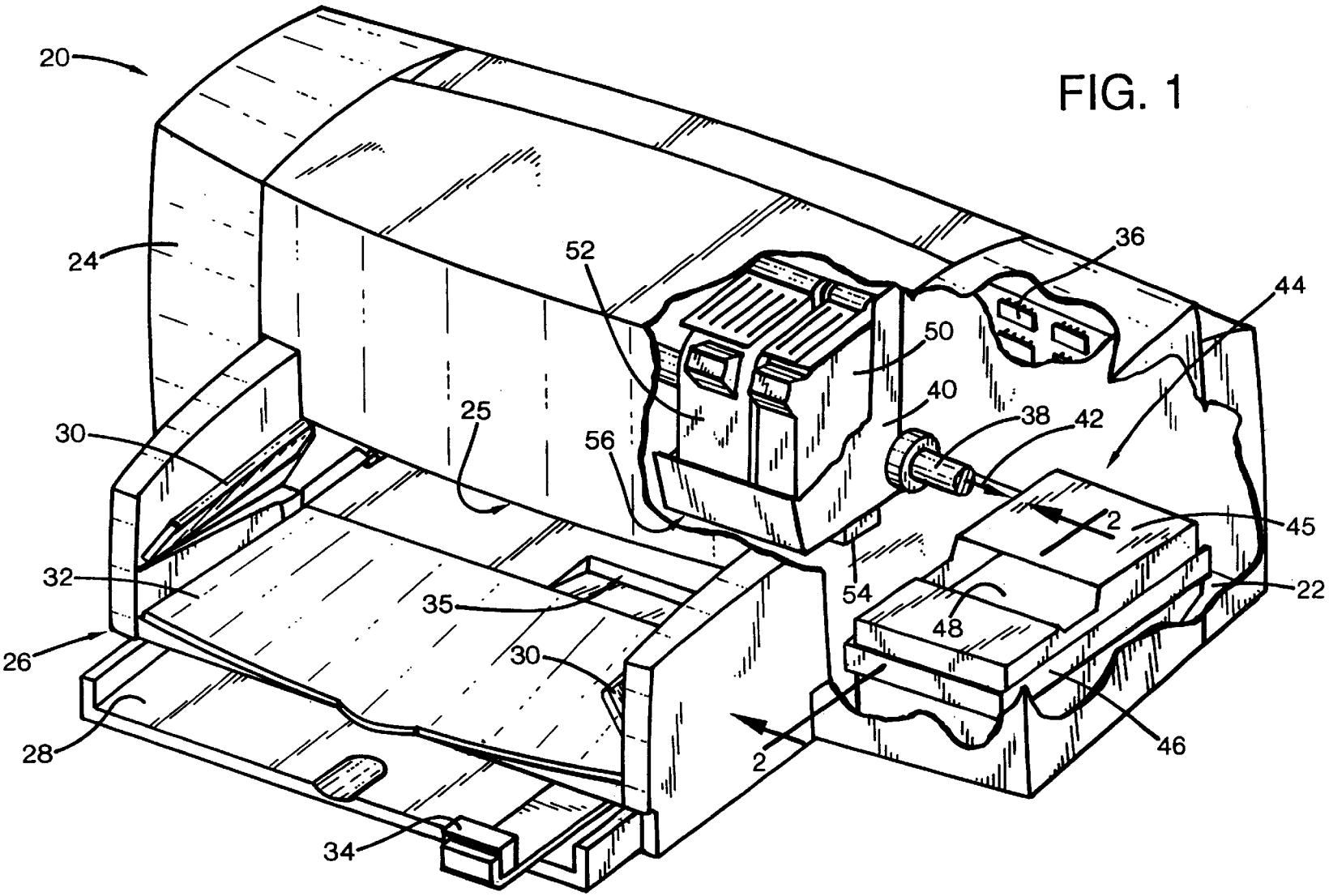
FIG. 1 is fragmented perspective view of one form of an inkjet printing mechanism employing a monitoring system of the present invention for monitoring pressure waves developed during jet droplet formation, and for adjusting operation in response thereto.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a print zone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional or other motor-driven paper drive rollers (not shown) may be used to move the print media from tray 28 into the print zone 25 for printing. After printing, the sheet then lands on a pair of retractable output drying wing members 30, shown extended to receive a the printed sheet. The wings 30 momentarily hold the newly printed sheet above any previously printed sheets still drying in an output tray portion 32 before retracting to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an, inkjet carriage 40 for travel back and forth across the print zone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 36. For instance, a carriage drive gear and DC motor assembly may be coupled to drive an endless belt secured in a conventional manner to the pen carriage 40, with the motor operating in response to control signals received from the printer controller 36. To provide carriage positional feedback information to printer controller 36, an optical encoder reader may be mounted to carriage 40 to read an encoder strip extending along the path of carriage travel.

Figure 2:
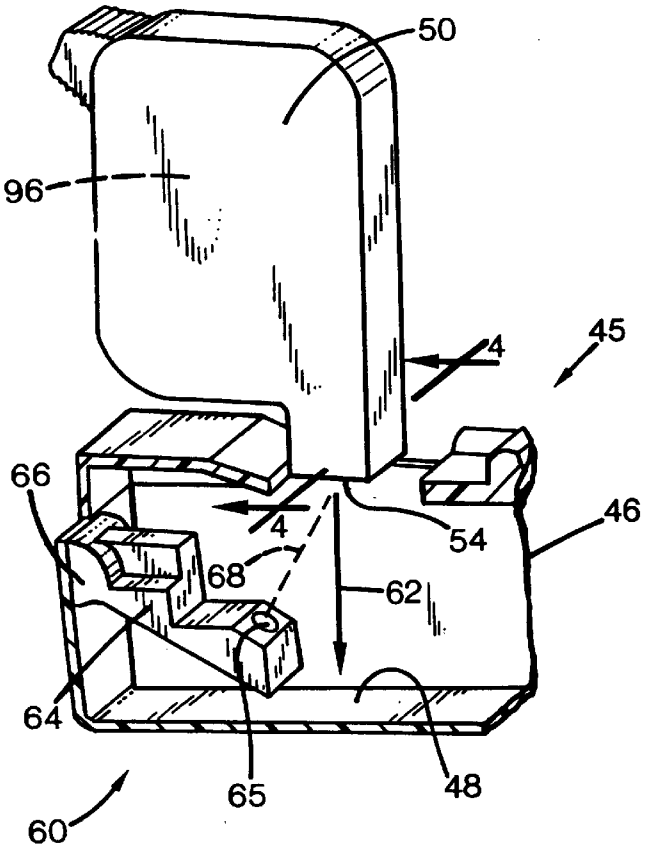
FIG. 2 is a section perspective view of one form of a sensor of the present invention, taken along line 2—2 of FIG. 1.

The carriage 40 is also propelled along guide rod 38 into a servicing region, as indicated generally by arrow 44, located within the interior of the casing 24. The servicing region 44 houses a service station 45, which may provide various conventional printhead servicing function. For example, a service station frame 46 may hold a conventional or other mechanism that has caps to seal the printheads during periods of inactivity, wipers to clean the nozzle orifice plates, and primers to prime the printheads after periods of inactivity. Such caps, wipers, and primers are well known to those skilled in the art. A variety of different mechanisms may be used to selectively bring the caps, wipers and primers (if used) into contact with the printheads, such as translating or rotary devices, which may be motor driven, or operated through engagement with the carriage 40. For instance, suitable translating or floating sled types of service station operating mechanisms are shown in U.S. Pat. Nos. 4,853,717 and 5,155,497, both assigned to the present assignee, Hewlett-Packard Company. A rotary type of servicing mechanism is commercially available in the DeskJet@ 850C and 855C color inkjet printers, sold by Hewlett-Packard Company, the present assignee. FIGS. 1 and 2 show a spittoon portion 48 of the service station, defined at least in part by the service station flame 46.

In the print zone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as paraffin based inks, as well as hybrid or composite inks having both dye and pigment characteristics.

The illustrated pens 50, 52 each include reservoirs for storing a supply of ink. In the illustrated embodiment, pen 50 has a spring-bag reservoir to provide the desired levels of backpressure to prevent nozzle leakage or "drool," while in contrast, the pen 52 has a foam-based reservoir design. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. The printheads 54, 56 typically include substrate layer having a plurality of resistors which are associated with the nozzles. Upon energizing a selected resistor, a bubble of gas is formed to eject a droplet of ink through the nozzle and onto a media sheet in the print zone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50, 52 to the printheads 54, 56.

Acoustic and Ultrasonic
Monitoring System

Sonic or audible sound waves are longitudinal waves that can be liquids and gases, such as air, and that can be detected by the human ear, as well as other sensors, typically in an audible range up to about 20,000 Hz (20 kHz). Above the audible range, they referred to as ultrasonic waves. When traveling through solids, these also have transverse components, so they may be generally referred to as a "stress wave." In firing an inkjet printhead nozzle, a pressure wave may be generated that has a variety of components, some of which may be in the audible range, while others may be in the ultrasonic range. Unless otherwise specified, as used herein the term "Pressure wave" is understood to include longitudinal mechanical waves in both the acoustic and ultrasonic frequency ranges, typically traveling through air, as well as vibrations when traveling through a solid.

A. First Embodiment

FIG. 2 shows a first embodiment of a monitoring system 60 constructed in accordance with the present invention for monitoring a pressure wave developed in the surrounding ambient environment, here in air, during ink droplet formation as the printhead 54 of pen 50 is fired into spittoon 48, as illustrated by arrow 62. For clarity, the color pen 52, carriage 40, and remaining printer and service station components are omitted from the view of FIG. 2, although it is apparent that the concepts illustrated herein are also applicable to operation of the color pen 52. A support member 64 is mounted to the service station frame 46, near the spitting location.

The monitoring system uses either vibratory, acoustic, audible, ultrasonic, or other pressure wave monitoring mechanisms, such as a laser vibrometer or an accelerometer sensor, for instance, a microphone device 65 supported by member 64. The support 64 may also house microphone electronics, indicated generally at location 66, which are in communication with the controller 36 via conductors preferably routed through the interior of enclosure 24. Preferably, the microphone 65 is a directionally oriented, line-of-sight transducer, positioned toward the printhead 54 to "listen" for droplet formation, as indicated by the dashed line 68. Line-of-sight monitoring is preferred to avoid contamination of the pressure wave by ambient noise generated by the printer itself, by other background sources in the local environment adjacent the printer 20, or by reflections of the pressure wave (although if captured, these reflections may be used to help amplify or attenuate the monitored pressure wave to obtain a better transducer signal). Before discussing the various methods of operating the monitoring system 60, several alternate sensor locations will be illustrated with respect to FIGS. 3 and 4.

B. Second Embodiment

Figure 3:
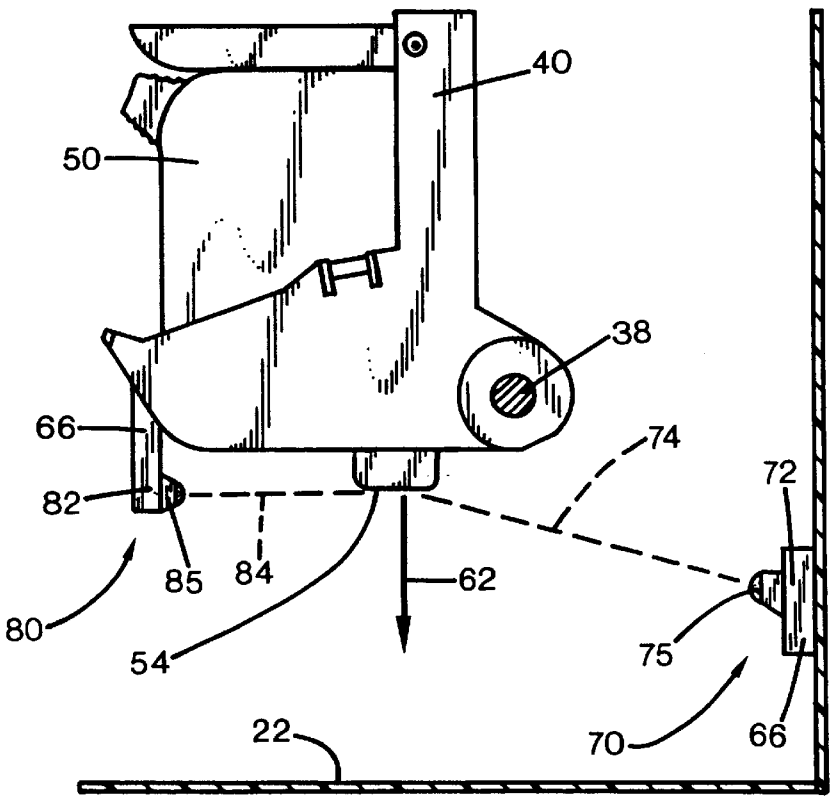
FIG. 3 is a side elevational view of two alternate forms of a sensor of the present invention, any of which may be substituted for the sensor of FIG. 2.

In FIG. 3, two additional embodiments of a monitoring system constructed in accordance with the present invention are illustrated, although it is apparent that only one such system would typically be used on a given printing mechanism, but in other implementations, two or more of these monitoring locations may be used. For instance, in a manufacturing context, a linear array of sensors may be used to sonically or ultrasonically detect nozzle performance to monitor printhead quality at the factory or in other noisy environments. The illustrated second embodiment of a chassis-mounted monitoring system 70 has a support member 72 mounted to the printer chassis 22 in a location adjacent either the print zone 25, or adjacent the service station 45. The support 72 is located for a line-of-sight positioning, indicated by the dashed line 74, of a microphone device 75, which may be as described above for system 60. The support 72 may also house microphone electronics 66, as described above.

C. Third Embodiment

FIG. 3 shows a third embodiment of a carriage-mounted monitoring system 80, constructed in accordance with the present invention, and having a support member 82 mounted to the printer carriage 40. The support 82 is located for a line-of-sight positioning, indicated by the dashed line 84, of a microphone device 85 or other type pressure wave monitoring mechanism, as described above for the system 60. The support 82 may also house microphone electronics 66, as described above. Communication between the controller 36 and the microphone electronics 66 may be accomplished via a portion of the same conductor system that delivers firing signals to the carriage 40 from controller 36. For example, one or more conductors within a conventional flexible conductor strip (not shown) that couples the carriage 40 to the controller 36 may be dedicated to the monitoring system 60, rather than to printhead firing or printhead temperature monitoring (typically accomplished using a temperature sensing resistor integrally constructed within the printhead silicon).

D. Fourth Embodiment

Figure 4:
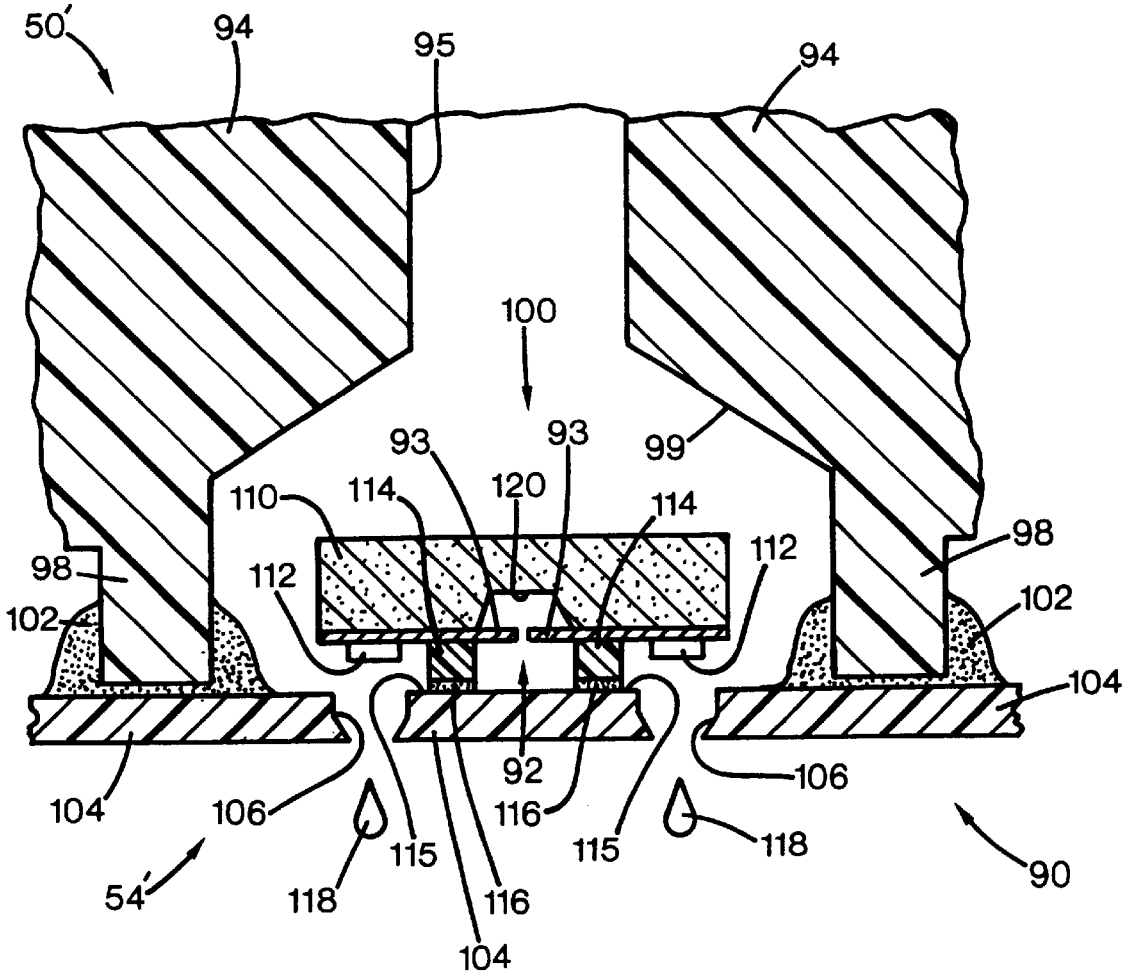
FIG. 4 is an enlarged sectional elevational view of one form of the third embodiment of the sensor of the present invention, shown integrally formed in a portion of an inkjet printhead in a view taken from the perspective along line 4—4 of FIG. 2.

FIG. 4 shows a fourth embodiment of an printhead-mounted monitoring system 90, constructed in accordance with the present invention as having either a laser vibratory, acoustic, audible, ultrasonic, or other type of pressure wave monitoring mechanism, such as an accelerometer sensor 92 integrally formed within the silicon of the printhead. The sensor 92 is integrally formed within printhead 54' of pen 50', which otherwise may be of the same construction as described above for pen 50, and in particular, as described in U.S. Pat. No. 5,420,627, which is assigned to the present assignee, Hewlett-Packard Company. The illustrated printhead 54, 54' has 300 nozzles total, arranged in two mutually parallel linear arrays of 150 nozzles, with each nozzle array spanning a length of around 12.7 mm (0.5 inches). It is apparent that the principles of sensor 92 illustrated with respect to the black pen 5' may also be applied to the tri-color pen 52, or to other printhead assemblies, including piezo-electric printheads. The technology for fabricating the sensor 92 within a silicon integrated circuit chip is known to those skilled in the art, and can be accomplished with the same economical bulk micro-machining techniques used to fabricate pressure sensors and accelerometers, such as to form one or more cantilevered reed or beam type accelerometers 93. Either the printhead 54', the cartridge 50', or the controller 36 may house all or a portion of the sensor electronics package 66 (omitted for clarity from FIG. 4). Communication between the printhead sensor 92 and controller 36 is preferably accomplished in parallel with the communication path of the firing signals and printhead temperature monitoring signals, as described above for system 80, except that the electrical interconnect between the pen 50' and the carriage 40 is also used.

The illustrated cartridge 50' has a plastic body 94 that defines an ink feed channel 95, which is in fluid communication with an ink reservoir located within the upper rectangular-shaped portion of the cartridge, such as reservoir 96 shown in FIG. 2. The body 94 also has a raised wall 98 that defines a cavity 99 at the lower extreme of the feed channel 95. An ink ejection mechanism 100 is centrally located within cavity 99, and held in place through attachment by an adhesive layer 102 to a flexible polymer tape 104, such as Kapton® tape, available from the 3M Corporation, Upilex® tape, or other equivalent materials known to those skilled in the art. The illustrated tape 104 serves as a nozzle orifice plate by defining two parallel columns of offset nozzle holes or orifices 106 formed in tape 104 by, for example, laser ablation technology. The adhesive layer 102, which may be of an epoxy, a hot-melt, a silicone, a UV curable compound, or mixtures thereof forms an ink seal between the raised wall 98 and the tape 104.

The ink ejection mechanism 100 includes a silicon substrate 110 that contains a plurality of individually energizable thin film firing resistors 112, each located generally behind a single nozzle 106. The firing resistors 112 act as ohmic heaters when selectively energized by one or more enabling signals or firing pulses 228 (FIG. 11), which are delivered from the controller 36 through a flexible conductor to the carriage 40, and then through electrical interconnects to conductors (omitted for clarity) carried by the polymer tape 104. A barrier layer 114 may be formed on the surface of the substrate 110 using conventional photolithographic techniques. The barrier layer 114 may be a layer of photoresist or some other polymer, which in cooperation with tape 104 defines vaporization chambers 115, each surrounding an associated firing resistor 112. The barrier layer 114 is bonded to the tape 104 by a thin adhesive layer 116, such as an uncured layer of polyisoprene photoresist. Ink from the supply reservoir 96 (FIG. 2) flows through the feed channel 95, around the edges of the substrate 110, and into the vaporization chambers 115. When the firing resistors 112 are energized, ink within the vaporization chambers 115 is ejected, as illustrated by the emitted droplets of ink 118.

As shown in FIG. 4, the sensor 92 is housed within a resonance chamber 120 that is defined by cooperation of the substrate 110, barrier layer 114, tape 104, and the adhesive layer 116. The resonance chamber 120 isolates sensor 92 from ink flowing through the cavity 99 and vaporization chambers 115, which is believed to enhance the sensor's performance. It is apparent that in some implementations, it may be preferable to locate all or a portion of the sensor in the ink, such as within cavity 99, in the vaporization chambers 115, or adjacent thereto. As mentioned above, the illustrated sensor 92 may be constructed with the same techniques used to fabricate pressure sensors and accelerometers to form one or more cantilevered reed or beam type accelerometers 93, two of which are shown in FIG. 4, preferably in the same plane as the firing resistors 112. Alternatively, the accelerometers may be replaced with a polysilicon strain gauge that detects electrical current changes in response to deflection. The resonance chamber 120 may run along the length of the two linear nozzle arrays (each represented by a single nozzle 106 in FIG. 4), with a group of these reeds 93 distributed along the entire length of the chamber, or clustered in one or more locations. For instance, only one reed 93, or more preferably two reeds for redundancy, may be located in the middle region of the substrate 110, at a corner, or perhaps one (or two) on each end of the nozzle arrays.

Figure 11:
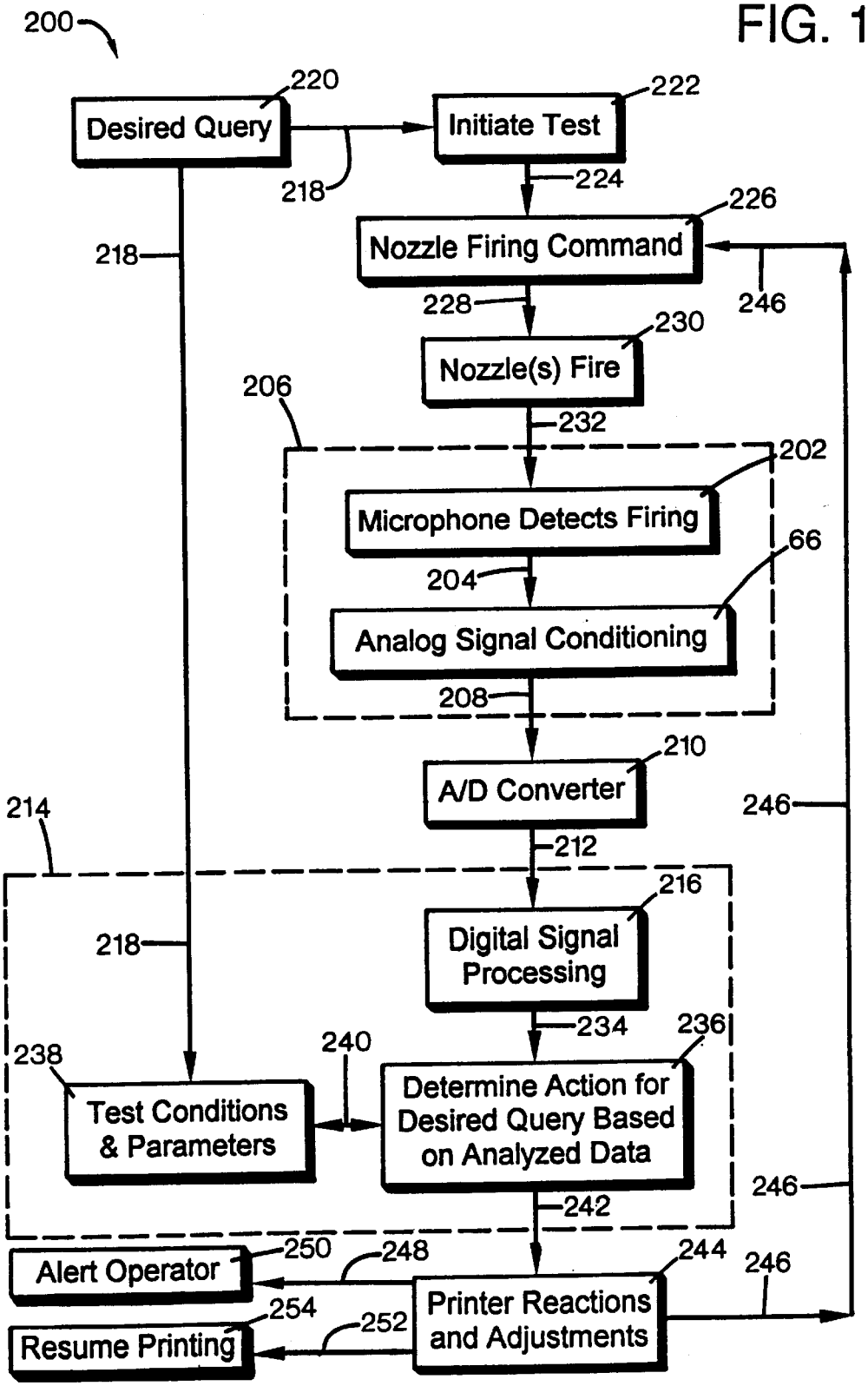
FIG. 11 is a flow chart illustrating one manner of operating the inkjet printing mechanism and monitoring system of FIG. 1.

The sensor reeds 93 are believed to detect the vibration of the silicon substrate 110 during firing, either in the acoustic or ultrasonic frequency ranges. For the illustrated cartridge 50', the firing frequency is about 12 kHz, so the sensor reeds 93 may be tuned to oscillate at a natural vibratory frequency of 12 kHz. If other frequencies are to be detected, then the reeds 93 may be tuned to these other frequencies by adding a seismic mass near the end of the reed that is suspended in the resonance chamber 120. Indeed, the sensor 92 may have several reeds 93 all tuned to detect different frequencies, or groups of frequencies. In operation, a small current is run through the reeds 93, which deflect when encountering the resulting pressure initiated or radiated during pen firing. Here, the accelerometer reeds 93 operate in the same manner as a polysilicon strain gauge, detecting electrical current changes in response to deflection. This deflection changes the electrical resistance of the reeds 93, which may then measured and correlated to the frequency detected using conventional techniques known to those skilled in the art to generate a wave signal 204 (FIG. 11).

In conclusion, the selection of which sensor system 60, 70, 80 or 90 to use may vary depending upon the type of printing mechanism being designed, and its priority of desired features. For example, one advantage of mounting the sensor 85 of system 80 to the carriage 40, is that the signal may also be measured during printing, not just during spitting as for system 60, or when located near a chassis mounted sensor 75. Thus, a carriage based measuring system 80, or a printhead mounted system 90 may increase throughput (rate usually measured in pages per minute), as monitoring does not require the printhead to be stopped in a particular location. Indeed, in some implementations, it may be desirable just to learn whether a nozzle is firing or not, and then to substitute other nozzles for a misfiring or a damaged nozzle to maintain print quality. Other systems may look at the actual level of the signal being detected, for instance, to determine optimal turn-on energy, such as by making amplitude measurements, so more precise sensor to printhead positioning is required, with the most precise embodiment being the on-board system 90.

Wave Signal Graphs

Figure 5:
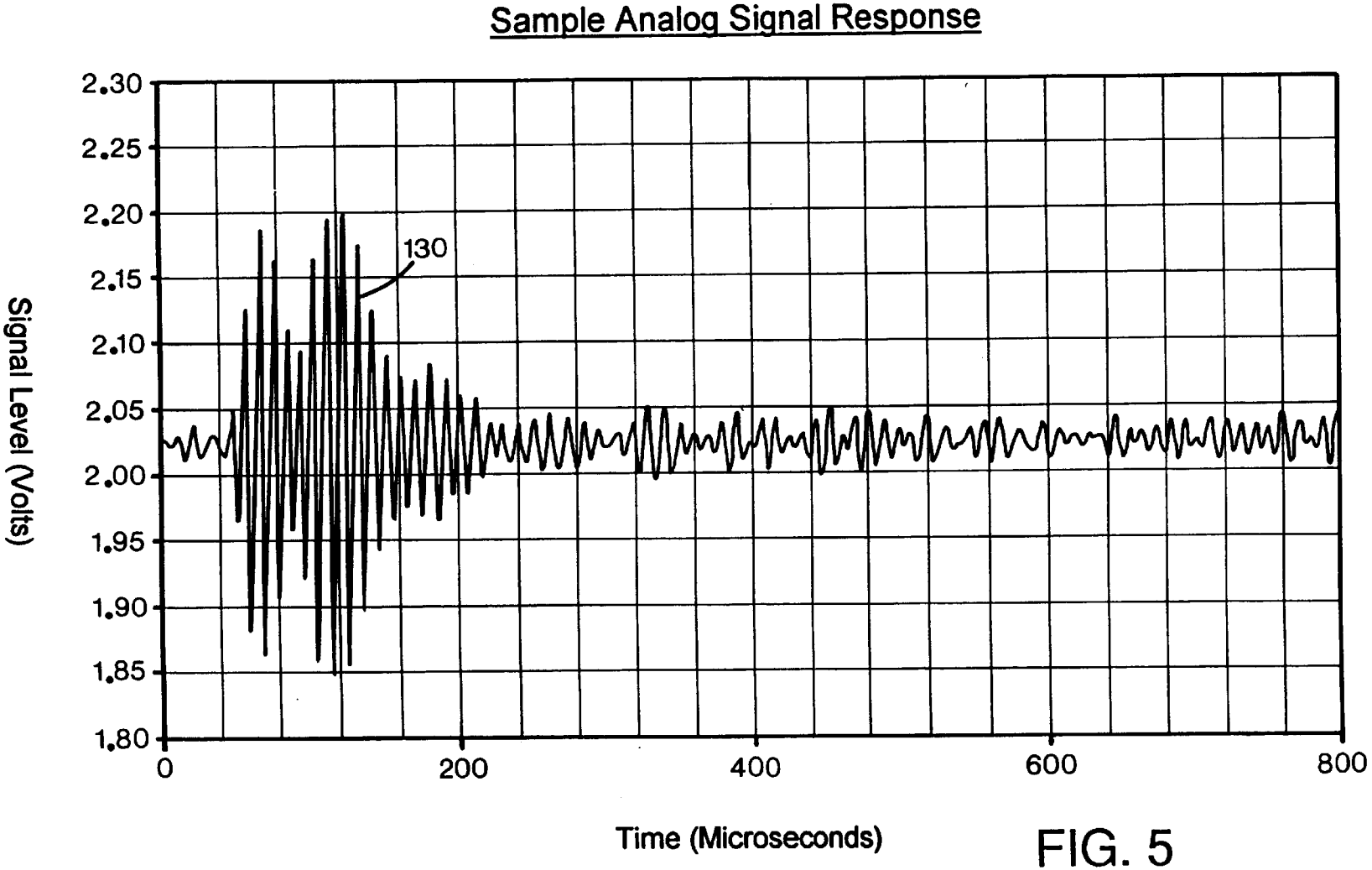
FIGS. 5 and 6 are graphs illustrating sensor information generated using two different sensor embodiments in the monitoring system of FIG. 1.
Figure 6:
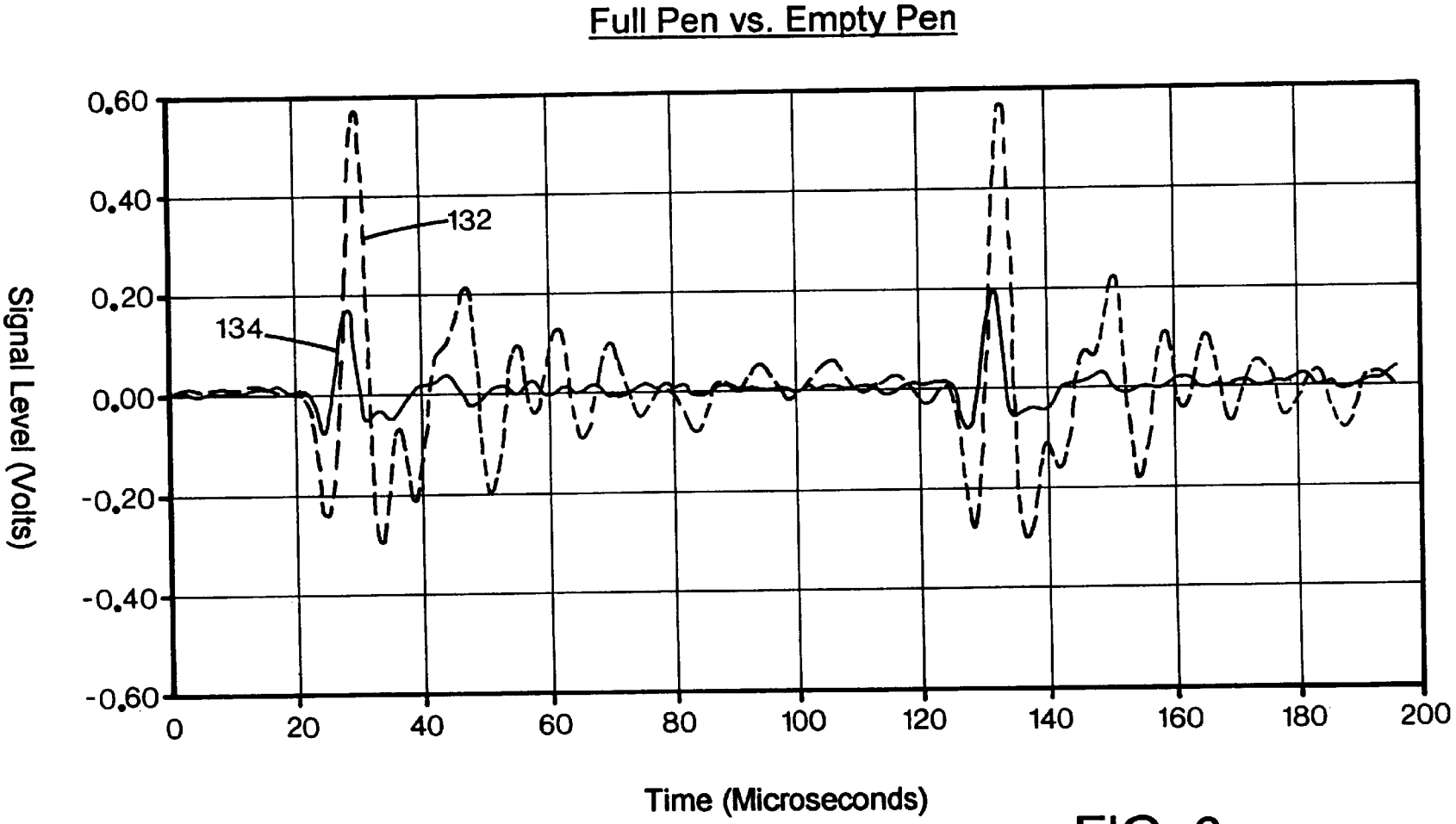

In response to monitoring of inkjet droplet formation 62 by any of the monitoring systems 60, 70, 80 or 90, the illustrated sensor electronics 66 generate a wave signal 204 (FIG. 11) in response to the pressure wave produced during droplet formation. This wave signal 204 is typically an analog signal that can be illustrated graphically, for instance as shown in FIGS. 5 and 6. The trace 130 in FIG. 5 was made by monitoring the firing of one nozzle of the black printhead 54 using a 40 kHz piezo-electric microphone. This 40 kHz microphone is commercially available and relatively inexpensive (cost of around $2.00), so it that may be economically installed on inkjet printers for home and business use, for example. The trace 130 was initiated at time zero, which corresponded to the time the firing pulse was applied to the resistor associated with the fired nozzle.

Now if cost is not a constraint, FIG. 6 shows the results of using a very sensitive and costly broad band microphone (cost of around $2500.00, including the associated electronics, ), which was used during initial conceptual tests to prove the overall ultrasonic drop detection principle. This broad band microphone had a bandwidth of 160 kHz, so it detected all frequencies up to 160 kHz, rather than focusing on a single frequency like the inexpensive piezo-electric microphone used to generate curve 130 in FIG. 5. Two traces are shown in FIG. 6. The dashed trace 132 shows the ultrasonic pressure wave emitted or radiated by pen 50 when firing a single drop of ink 118 from a single nozzle 106 when the pen is full of ink. The solid trace 134 was made by firing a single nozzle 106 when the pen was empty. Only one firing frequency was used in FIG. 6 with the frequency between firing the fill ink nozzle and the empty nozzle being about 10 kHz. This 10 kHz value was just a convenient interval selected to locate the two pulses in the same time window, while spreading the traces 132 and 134 apart enough so the waveform of the first nozzle will have dampened out enough to avoid interference with the waveform of the next nozzle. The full pen waveform 132 has a different wave signature, as well as a higher peak amplitude, than that of the empty pen waveform 134.

Indeed, even when using the more economical 40 kHz piezo-electric microphone of FIG. 5, the signal strength (amplitude) was found to drop when the pen had emptied during use. For example, a fill pen had a peak-to-peak voltage amplitude of around 1.0 volts, whereas an almost empty pen had an amplitude decrease to about 0.6 volts peak-to-peak, while a dry pen had a peak-to-peak voltage of only 0.2 volts. This difference shows that the pressure wave is not solely due to ink injection, but the pressure wave also reflects other contributing factors occurring within the cartridge. Comparison of the full cartridge trace 132 with the empty trace 134 clearly shows a change in signal level, which may be compared with given threshold values to signal an imminent out-of-ink condition. This signal may be used to warn an operator of a nearly empty state, so a new pen may be available when the pen finally empties (see step 250 in FIG. 11).

Figure 7:
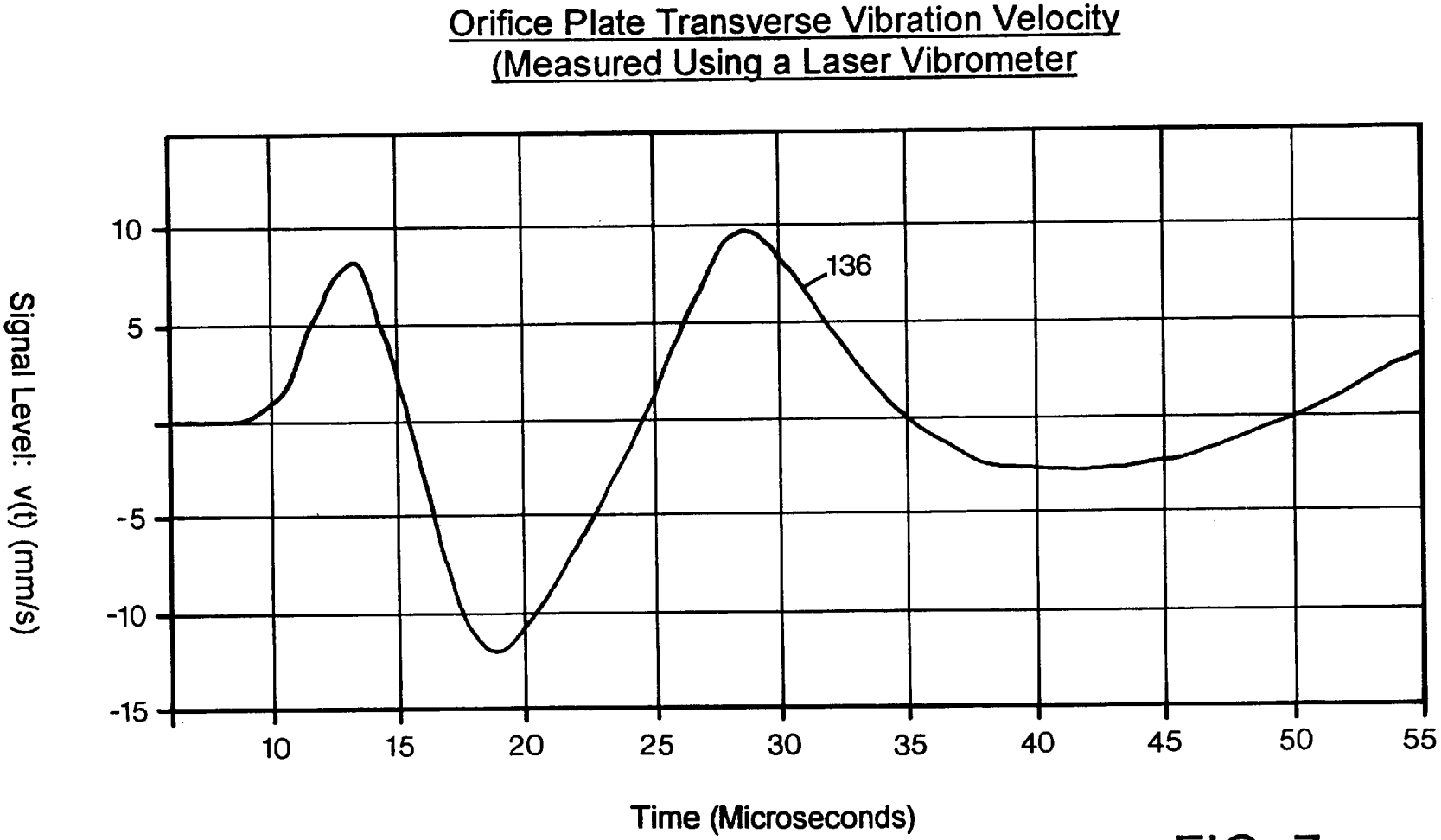
FIG. 7 is a graph of the transverse vibration velocity of a printhead orifice plate next to a nozzle which is firing.
Figure 8:
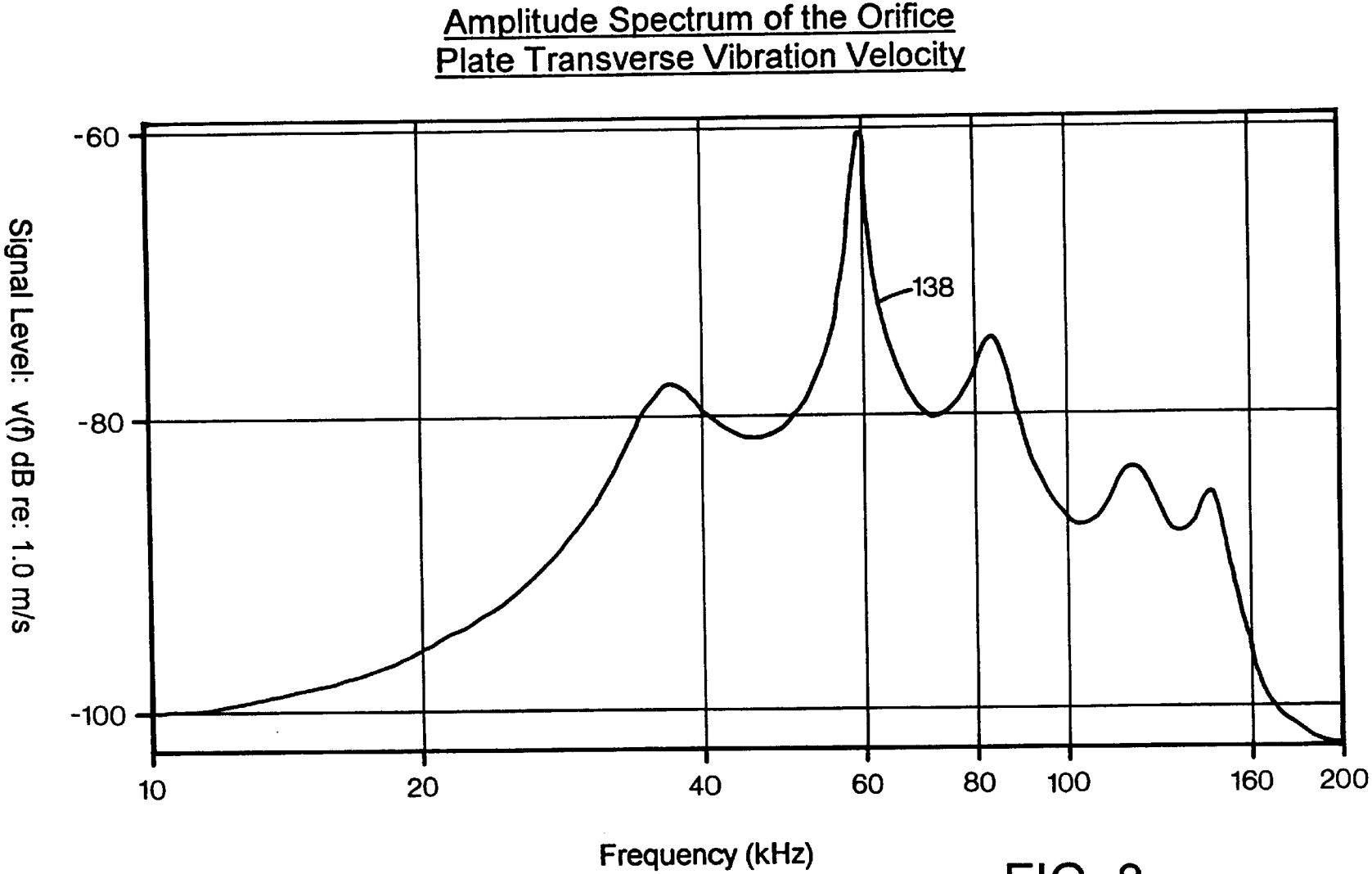
FIG. 8 is a graph of the amplitude spectrum of the waveform of FIG. 7.

If laser vibrometer were used as the sensor 65, 75, 85 to detect the vibration using a laser beam, as was done during conceptual testing, the deflection in shape or transverse velocity of the orifice plate 104 can be measured to indicate functionality of individual nozzles. In this laser measurement technique, the vibration velocity of the orifice plate is measured by detecting changes in the frequency shift or the angle at which a laser beam is reflected off of the orifice plate 104. These changes in the angle of the reflected laser beam may be translated into the degree of orifice plate deflection. For example, FIG. 7 shows a trace 136 of the transverse vibration velocity of the orifice plate 104 next to a nozzle 106 which is firing. FIG. 8 shows a trace 138 of the amplitude spectrum of the waveform of FIG. 7. While such a laser beam sensor solution may not be cost effectively incorporated in the final printer product, it may be a very promising technique to use in the manufacturing process to monitor the quality of the printhead assemblies. It is apparent that as technology advances, it may be possible to design a cost effective laser beam sensor system for the final printer product.

Figure 9:
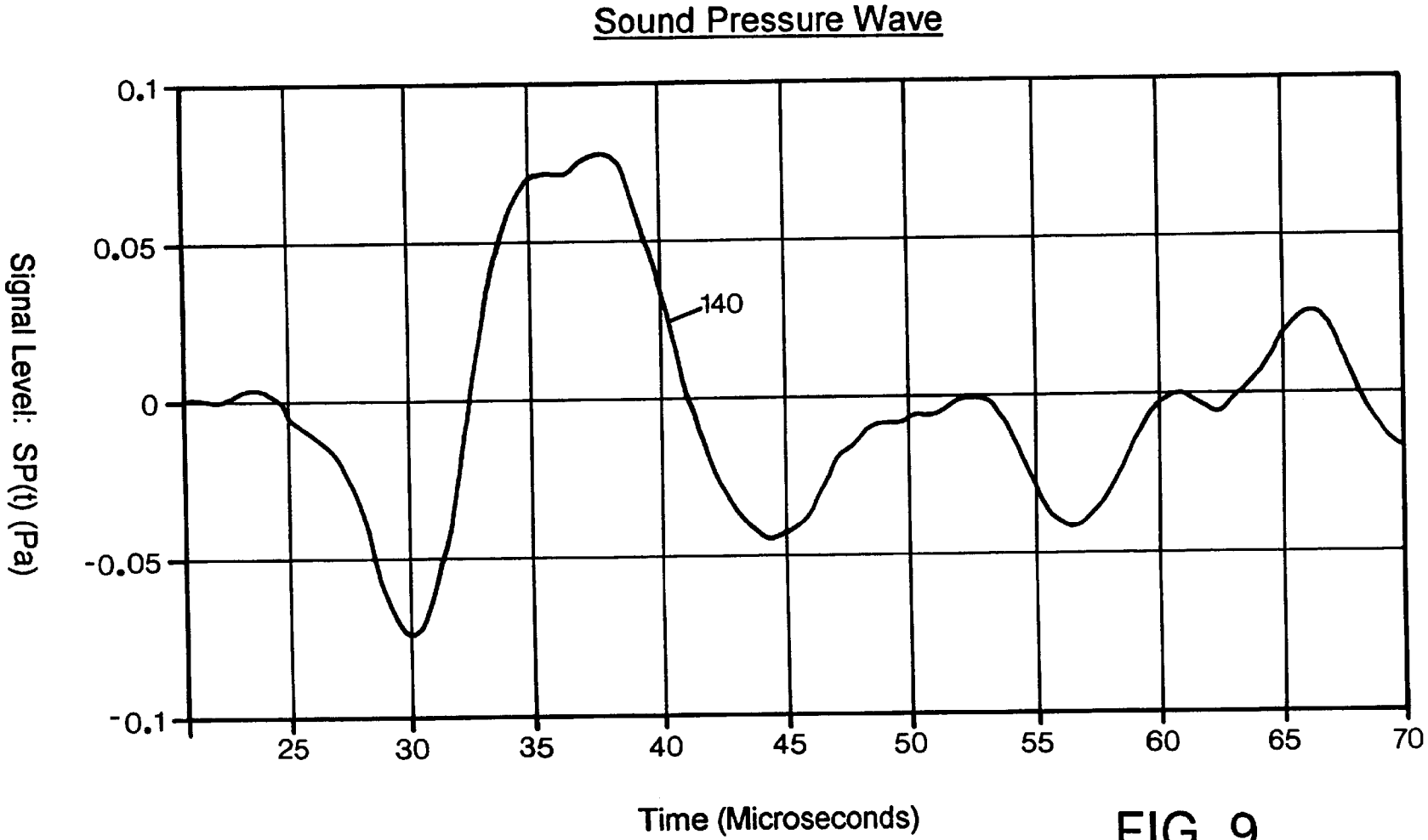
FIG. 9 is a graph of a sound pressure wave generated from the droplet formation or nozzle firing process, measured by a wide frequency band microphone sensor.
Figure 10:
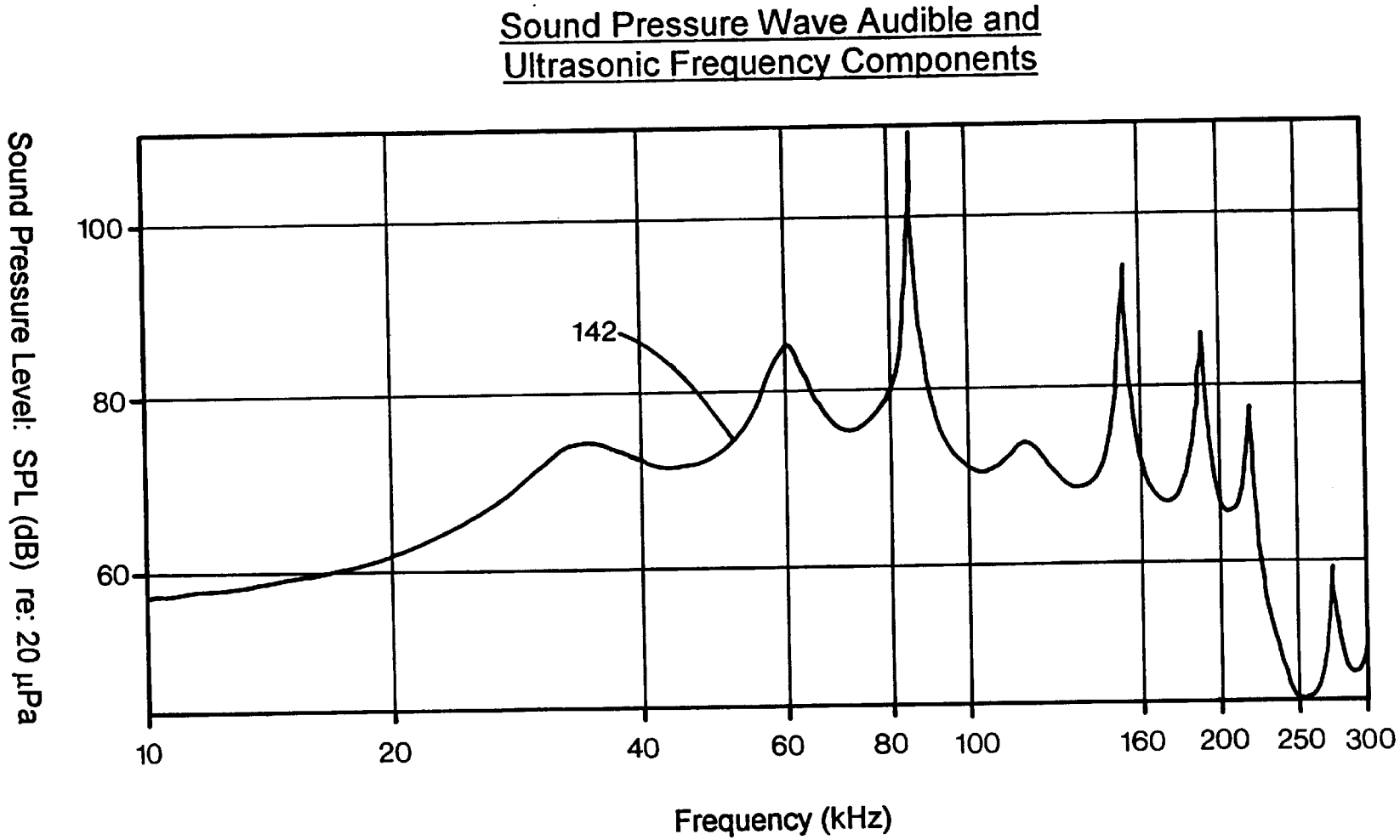
FIG. 10 is a graph of the audible and ultrasonic frequency components of the waveform FIG. 9.

FIG. 9 shows a sound pressure wave trace 140, with a duration of less than 50 microseconds, generated from the droplet formation process or nozzle firing process. This pressure wave of FIG. 9 is very impulsive, being rich in frequency components, including both audible and ultrasonic frequency components, as shown for trace 142 in FIG. 10.

Method of Operation

FIG. 11 is a flow chart 200 that illustrates one embodiment of a method of controlling an inkjet printing mechanism, here, an inkjet printer 20, in response to monitoring of inkjet droplet formation by any of the illustrated monitoring systems 60, 70, 80 or 90. In a detection or monitoring step 202, the sensors 65, 75, 85, 92 monitor pressure waves in the acoustic or audible range, for instance, and in response thereto, the sensors generate a wave signal 204, such as an analog signal, that is received by the electronics 66 associated with each microphone. The microphone electronics 66 may include signal conditioning features required by the particular type of sensor 65, 75, 85, 92 being used. For example, these electronics may include amplifiers and band pass filters, such as a high gain, high Q band pass filter, for analog signal conditioning of the wave signal 204. The sensors 65, 75, 85 and electronics 66 are preferably mounted on a single printed circuit board assembly 206, which may be supported in the printer 20 by members 64, 72, 82 respectively, whereas the electronics 66 associated with the printhead mounted sensor 92 may be located anywhere between the printhead 54', the controller 36 and the host computer. Where ever the electronics 66 are located, in response to the wave signal 204, the electronics 66 preferably perform a signal conditioning function, such as analog signal conditioning including analog signal amplification and filtering, to generate a conditioned wave signal 208.

In the detection or monitoring step 202, the sensors 65, 75, 85, 92 monitor the sound field radiated by nozzle firing (or by the application of firing signals) pressure waves. These pressure waves may be in the acoustic or audible range, 10 Hz to 20 kHz, or in the ultrasonic range, for instance, 20 kHz to 500 kHz, or greater, depending upon the technology available for monitoring. Indeed, while the illustrated embodiment anticipates an upper frequency level of 500 kHz, the true upper limit may actually be in the megahertz band, assuming the technical ability exists to monitor such high frequencies. For instance, due to the inverse relationship of the signal strength amplitude and the monitoring distance, the sensor must be located physically close enough to the printhead to receive the pressure wave. Other technicalities to address before monitoring pressure wave frequencies in the megahertz band include data sampling constraints, which are presently a function of the available electronics. However, it is apparent that there is an upper limit that may be measured when transmitting through air, due to the upper limit on the compressibility of air. The relatively inexpensive piezo-electric disk-type microphone used to generate curve 130 of FIG. 5 measured in the 40 kHz ultrasonic range.

Before completing the description of flow chart 200, the phenomena of the pressure wave monitored in step 202 will be discussed, with reference to studies of the concept. For convenience, refer to FIG. 4 for basic printhead construction, realizing that the tests were conducted using printhead 54, without sensor 92. The various merits of acoustic monitoring versus ultrasonic monitoring will also be compared. Another factor effecting pressure wave monitoring discussed below is sensor placement relative to the printhead. But first, the question to be answered is, "What generates the acoustic and ultrasonic components of the pressure wave that is monitored?"

A. Acoustic Pressure Wave Studies

Initial conceptual testing centered on measuring pressure waves developed in the audible range using a microphone as the sensor. These initial tests were directed toward a method of determining the out-of-ink condition, and more particularly to give an early warning of an impending empty condition. Unfortunately, too much background noise from other audio sources nearby printer 20 was also picked up by the microphone. The magnitude of the background noise yielded such a poor signal to noise ratio that the system failed to give consistently reliable results.

Other early studies looked at the vibration of the printhead silicon 110 and the orifice plate 104, as well as the sound perceived versus the drop volume emitted. In one of these early vibratory studies, the operational shape deflection of the orifice plate 104 was measured using scanning laser vibrometer, where the change in phase or frequency shift was determined between a laser beam reflected by the orifice plate 104 and a reference laser beam. According to Doppler theory, this frequency shift is proportional to the velocity at which the object is moving. There is a vibration signal for each point that is scanned, as shown in FIG. 8. The deflection shape may be obtained by integrating the vibration velocity, which is directly measured using the laser vibrometer. One advantage of this technique is that it does not affect the measured system because it is a non-contacting measurement technique. Furthermore, synchronizing the nozzle firing with the velocity measurements can help to reduce noise in the signal.

In the acoustic studies, the printhead silicon 110 was found to vibrate at its resonances after the initial impulsive response of the printhead. Specifically, when using a 3 kHz firing frequency, in one study a 12 kHz acoustic signal was measured, while in another study the orifice plate 104 also resonated at 9 kHz. Thus, it is expected that other firing frequency harmonics may also be measured, such as 6 kHz, 12 kHz, 15 kHz, etc. Unfortunately, other problems with resonance in the audible range were encountered. For example, the two metal side panels on the pen body of the black cartridge 50 were found to resonate at around 9 kHz, which was also the same frequency at which the orifice plate 104 was found to resonate. Thus, it would be difficult to distinguish whether the measured sound was emitted by the orifice plate 104, by the printhead silicon 110, or by the pen body.

In these audio frequency range, below 20 kHz, it also is believed that that the sound source may be the vibration during firing of the printhead silicon 10, or the thermal expansion of the heater resistor 112, or possibly both. This belief is based on the fact that the microphone sensors detected pressure waves when a droplet 118 was formed, and when firing signals were sent to an empty cartridge. Another theory is that the sudden very hot and very fast heating of the resistor 112 forms a "heat" bubble, that is, a localized expansion of air in the firing chamber 115 when the pen is empty. As the heat bubble of the empty pen expands and occupies more space, the heat bubble creates a pressure field in the ink and air. When an empty pen is fired, the pressure wave is developed in air, whereas when a full (or partially full) pen is fired, the pressure wave is developed in the fluid ink. The amplitude of the pressure wave changes because air and ink have very different acoustic impedances, and thus different acoustic wave radiation efficiencies. The difference in the signal amplitude from full to empty is believed to be due to the pen structure and related fluid properties, as well as bubble formation.

Indeed, while the exact source of the pressure wave generated is not completely understood at this time, this is not critical to the present invention. The essential factor is that an acoustic or ultrasonic pressure wave is generated, detected, and then actions are taken in response to this detection.

B. Ultrasonic Pressure Wave Studies

Following the initial audible range tests, ultrasonic monitoring of drop formation was tested. At the ultrasonic frequencies, the sound source may be the actual creation of a single inkjet bubble, with the ultrasonic signal occurring in the range of the time it takes to create the bubble. Bubble expansion due to thermal diffusion was found to generate a pressure wave of around 80 kHz in the illustrated embodiment, whereas the pressure wave from bubble collapse occurred at a frequency of around 160 kHz. These terms will be better understood after discussing the droplet formation process.

Referring to the printhead cross section in FIG. 4, the drop ejection process starts with the firing chamber 115 filling with ink and electric current being applied to the thin film resistor 112 in the chamber. The electric current heats the resistor 112, and the heat energy is then transferred from the resistor to the ink, which begins to build pressure in the firing chamber. Eventually, the ink begins to boil and a vapor bubble is formed. This bubble grows to a maximum size, a droplet 118 of ink is ejected or pushed out of the nozzle 106 and then the bubble collapses. The act of pushing the droplet 118 out creates an opposite force that may cause the orifice plate 104 to vibrate. The heat of the firing process may also cause the silicon 110 to expand and contract, creating a thermal stress wave. When the ink droplet 118 is ejected, the remaining ink is pulled back into the firing chamber 115 as the bubble collapses. This collapse may also cause the silicon substrate 110 to vibrate. More ink then flows into the chamber 115 to replenish it for firing another droplet.

When the pen has run out of ink, applying electric current to the resistor 112 still causes it to heat up. When no ink is present in the firing chamber 115, the thermal expansion of the local air or the silicon resistor 112 may be the cause of the signal that is monitored with a dry pen. Alternatively, when the resistor 112 of an empty pen is energized, the heat builds up in the chamber 115 and may be sent out as a pressure wave through the nozzle 106, generating the ultrasonic signal. The 80 kHz signal measured with the illustrated pen 50 may be due to bubble growth in a fill pen, and due to thermal shock of the resistor 112 when the pen is empty. The 160 kHz signal may be due to the bubble collapse immediately following droplet ejection. Of course, other physical phenomena, thus far unknown, may be occurring within the printhead 54, 54' to generate the pressure wave when a dry pen is fired, but this remains to be verified.

Indeed, originally it was thought that the orifice plate 104 itself was vibrating, causing both the acoustic and ultrasonic signatures. However, in one test the orifice plate was completely removed from a full pen and the signal amplitude was approximately four times larger than the signal measured with the orifice plate 104 in place. For a dry pen, removing the orifice plate 104 had no effect at all upon the signal amplitude. Even the material of the orifice plate 104 may have some bearing upon these measurements. Ink viscosity variations were also tested, and without an orifice plate the signal amplitude increased as the ink viscosity increased. However, with the orifice plate in place, the dampening effect of the orifice plate negated the change in ink viscosity. Thus, in a commercial inkjet pen with an orifice plate, fortunately, ink viscosity has little if any effect upon the signal amplitude. Another way of amplifying the ultrasonic signal is to induce the ultrasonic frequency by supplying a series of firing pulses to either multiple nozzles or to the same nozzle at the desired ultrasonic rate.

Thus, while the original thinking was that the ultrasonic sound was generated during bubble collapse, the fact that an ultrasonic signal is still detectable when the pen is empty leaves the question open as to what exactly within the pen and printhead is generating the ultrasonic pressure wave, if not bubble collapse. Thus, while the source of the signal is not completely understood, it is detectable and useable to increase print quality. It is interesting to note that when a plugged nozzle was fired, no signal was measured, perhaps because it did not exist, or if it did, because it was buried in the signal noise. Thus, detection of ink clogs or other nozzle blockages using the monitoring system is quite viable. Various pens of the same type were also tested, and fortunately the variation in waveform signature between different pens was very small, leading to the belief that indeed this can be implemented in a commercial printing mechanism, which receives many different pens over its lifetime.

An alternate analysis of the test results has peen proposed. Here, the analysis begins by understanding that as the electric current heats the resistor 112, this heat energy is then transferred from the resistor to the ink and to the surrounding solid material, including the silicon 110, the orifice plate 104, barrier layer 114, etc. The heat transmitted into the ink generates a vapor layer around the firing resistor 112. This vapor layer then develops into a vapor bubble which deflects the ink toward the nozzle 106 and eventually pushes a droplet 118 out of the firing chamber 115. The heat transmitted into the surrounding solid material develops thermal stress waves in both the transverse and radial directions.

These stress waves in the solid material, and the force applied on the orifice 106 by the bubble generated ink deformation, may be the main source of vibration of the orifice plate 104, as well as the source of the sound pressure wave detected in the air surrounding the firing nozzle. The fact that a pressure wave is detected with and without the orifice plate 104 confirms the theory that the orifice plate 104 is not a primary source of the sound, but rather a secondary source. Furthermore, without the orifice plate 104, the pressure wave has a larger amplitude than with the orifice plate installed. This fact implies that the orifice plate 104 is acting as a damper to the transmission of the vibrations, and thus, as a damper to the radiation of sound from the nozzle firing act.

Since the acoustic impedance of ink is about 1000 times larger than that of air, it is more efficient to radiate sound in ink than in air. On the other hand, less sound is transmitted by the air/ink interface than if the pressure wave travels only in air because of the impedance mismatch at the interface. Tests showed a slight amplitude change between when the pressure wave travels through the ink/air interface for a pen containing ink (a "wet" pen), and when the pressure wave travels through only air for an empty ("dry") pen. This will not produce the significant difference in amplitude between the dry pen signal and the wet pen sound signals. The major difference between the wet and dry pen scenarios, is that there is a bubble formation process associated with a wet pen, but not with a dry pen. The bubble formation process generates a large deformation of ink and creates a large vibration at the orifice plate 104, so a larger sound signal is emitted from a wet pen than from a dry pen. Since the sound pressure wave is generated by the variation of pressure above or below atmospheric pressure, the nozzle 106 provides a free link for a dry pen from the air inside the firing chamber 115 to the surrounding atmosphere. Thus, the signal amplitude for a dry pen remains at substantially the same level both with and without the orifice plate 104 in place. Both the vibration and sound pressure signals are very impulsive, as illustrated by trace 142 in FIG. 10, which means that they both are rich in audible and ultrasonic frequency components, as shown in FIG. 9. The dominant frequency components are related to droplet formation.

Another factor influencing pressure wave detection is the type of ink containment system selected for the cartridge reservoir. As mentioned above, the black pen 50 has a spring bag design, whereas the tri-color pen 52 has three foam-filled reservoirs, one for each color. During studies, the spring bag inside the pen 50 was found to vibrate the sides of the pen body wall. Once this phenomenon was understood, then adjustments could be made to account for these vibrations, for instance, using a filtering scheme. The foam-based pen 52 has a more complex performance that resulted in a perceived inconsistency in the way it runs out of ink. This perceived inconsistency originally made it difficult to predict an upcoming out-of-ink condition. In the foam-based design, during printing or spitting the ink is randomly depleted from the foam cells around the printhead. This depleted region is then refilled through capillary action by ink wicking through the cells from remote regions of the reservoir. This refilling action often occurred so rapidly that the region around the printhead actually refilled before the pen could be positioned for testing. This quick refill lead to inconsistent test results, but of course, once the phenomenon was finally understood, the solution of more rapid testing became apparent. Thus, for a foam-based pen, the carriage-mounted sensor system 80 or the printhead-based system 90 may be more preferable, or suitable test timing modifications may be made to adapt the remaining systems 60 and 70 for accurate reporting.

Presently, the exact source which generates the ultrasonic signal is not fully understood, but indeed a measurable ultrasonic pressure wave is emitted during drop formation, and the information carried by this wave can be used to improve printer performance, as descnbed below with respect to FIG. 11.

C. Acoustic vs. Ultrasonic

Now that the question of what generates the acoustic and ultrasonic components of the pressure wave has been answered with, "We're not sure yet, but we have a few ideas," the various merits of monitoring the two frequency ranges will be discussed.

While detection of fundamental or harmonic acoustic frequencies may be useful for the currently available cartridges, it was believed this would be too limiting as a lasting solution. For example, if the material for the sides of the black pen 50 was changed, for instance from metal to a plastic, then the resonant frequency range may also change, so the whole measuring scheme would not work with the new pen architecture without upgrading the control system 200. Of course, these concerns could be addressed, for example, by assuming that the pen architecture will remain static during the lifetime of the printer.

The adverse effect of extraneous environmental noise on acoustic monitoring could be addressed in several ways. For instance, a second microphone could monitor the environmental noise and then subtract the noise from the sound heard by the drop detect microphone. The sensors 65, 75, 85, and possibly 92, may also be used to monitor the extraneous environmental sounds, which are then filtered out so only the firing or drop formation pressure waves are realized. Another option would be to isolate the drop detect microphone from the extraneous environmental sounds. Other means may also be used, such as averaging the sound detected, using time correlation, and then comparing measured values with a threshold. To improve a poor signal-to-noise ratio, more nozzles may be fired together at an instant, to increase the signal, but then single nozzle detection will probably be more difficult. Alternatively, the preferred minimum sampling rate for an audio range monitoring system needs to be at the Nyquist frequency, that is, at least twice the band width of the frequency of interest being measured to avoid aliasing, i.e. mixing of low and high frequency components. For instance, if a 6 kHz pressure wave was measured, then the optimal sampling rate would be at least 12 kHz. If the signal of interest is narrower in bandwidth, the sampling rate may be greatly reduced, which is more efficient. However, the design of the printer electronics 36 may impose an upper limit this sampling rate.

This ultrasonic system may depend at least in part upon bubble dynamics, that is, the creation of the ink droplet, rather than upon resonance of the pen body and printhead in response to droplet creation. While the particular cartridge studied had a thermal inkjet head, it is believed that these concepts may also be expanded to other types of inkjet printheads, such as piezoelectric printheads. As mentioned above, the current commercial embodiment anticipated uses a piezoelectric microphone which measures in the 40 kHz range. While higher frequencies may be more preferable, currently available microphones capable of measuring these higher frequencies are not cost effective for the home and business inkjet printer market, which typically sell inkjet printers in the cost range of $200–$1,000. However, it is believed that higher frequency ranges may provide better results. For example, an 80 kHz microphone is believed to provide better results than the commercially feasible 40 kHz microphone.

Thus, while the piezo-electric microphone used for ultrasonic monitoring may be slightly more expensive than an audio microphone, the immunity of the ultrasonic system to environmental noise contamination may render it more viable than an acoustic system. Furthermore, the ultrasonic system is not as dependent on pen architecture as the acoustic system, which monitors harmonics of the firing frequency. Some implementations may justify use of acoustic sensors, while others considerations may lead to ultrasonic monitoring for other implementations.

D. Sensor Placement

Another consideration in implementing the monitoring system 60, 70 or 80, is the location of the sensor 65, 75, 85 with respect to printhead 54. Indeed, the line of sight distance 68, 74, 84 was found to effect both the amplitude and the energy of the monitored signal. Specifically, when the microphone is located beyond the near field of the sound source, the amplitude measured in the far field is proportional to the reciprocal of the distance, 1/(distance), whereas the power level is proportional to the reciprocal of the square of the distance, $1/(\text{distance})^2$. If the microphone is located in the near field, small variations in the location of the printhead or microphone, such as due to manufacturing tolerances or shifting during use, may generate large fluctuations in the wave signal 204. Conversely, if the microphone is located too far away from the printhead, then it may be unduly influenced by background noise, with a loss in sensitivity. Also, if the distance is too great the signal-to-noise ratio may be too low to adequately process signal 204. Thus, there is a trade-off between the signal amplitude and the system stability as affected by the sensor position relative to the firing nozzle. Using the commercially viable 40 kHz microphone, it is believed that the optimal distance for the line of sight path 68, 74, 84 is approximately 12–25 mm (about 0.5–1.0 inch), although in the conceptual illustration of FIG. 3, the distance 74 is illustrated as being somewhat longer.

Indeed, while the line-of-sight or external sensors 65, 75, 85 are located a certain distance from the printhead, the printhead mounted or internal sensor 92 is directly in contact with the silicon substrate 110. Thus, sensor 92 is mechanically coupled to the printhead, rather than being coupled through air as illustrated by the line of sight distances 68, 74 and 84. In a broader sense, air itself may be considered to be a mechanical coupler, linking the printhead 54 to sensors 65, 75, 85. In other inkjet implementations, it is conceivable that the ink or other substance ejected from the printhead may travel through a liquid before hitting a recording surface, so the liquid would serve as the mechanical coupler between the printhead and sensor 65, 75, 85. On multiple cartridge printing mechanisms, using a single microphone to monitor the performance of each printhead may be more cost effective than providing a separate external sensor for each printhead. However, for increased printing speed, using one external sensor per printhead system may be preferred in some implementations.

E. Flow Chart

Referring back to flow chart 200 of FIG. 11, the controller 36 includes a commercially available analog to digital (A/D) converter 210 that receives the conditioned signal 208 from electronic 66. Besides the frequency range monitored, another constraint of current hardware is the sampling rate. Currently, commercially available A/D converters in a typical inkjet printer 20 are limited to processing about 125,000 samples per second. While a faster sampling rate may be preferred, the current embodiment is limited by this hardware constraint of the A/D converter 210. The conversion performed by the A/D converter 210 produces a digital wave signal 212.

The digital signal 212 then passes from the A/D converter 210 to a firmware decision making portion 214 of the printer controller 36, and more particularly to a digital signal processing portion 216 of the firmware 214. It is apparent that, while the illustrated preferred embodiment implements the decision making functions in firmware, that these functions may also be implemented in software, hardware, or combinations thereof, including firmware components if desired. Moreover, these functions may take place in the printer controller 36, in the host computer, or a combination thereof To encompass the concepts of these various physical manifestations of the system of flow chart 200, the various steps are referred to herein as "portions" of the system. Another input to the firmware portion 214 is a desired query signal 218, received from a desired query input portion 220. The desired query may be any of those listed in Table I below. The desired query signal 218 is also sent to an initiate test portion 222 of the control system. In response to the desired query signal 218, the initiate test portion 222 generates an initiate test signal 224.

Depending upon the desired query 220 chosen, the initiate test signal 224 may select a single nozzle, all nozzles, or a selected group of nozzles to be fired. Upon receiving the initiate test signal 224, a nozzle firing command portion 226 generates a nozzle firing or enabling signal 228. In response to receiving the nozzle firing signal 228, the particular resistor(s) 112 associated with the selected nozzle(s) 106 is fired in a firing step portion 230 of flow chart 200, with firing being conducted as described above with respect to the bubble formation discussion. Upon nozzle firing in step 230, a pressure wave 232 is normally emitted, which is then detected by the sensor in step 202, as described above.

Referring back to the firmware portion 214, the digital wave signal 212 is processed by the digital signal processing portion 216, which may be more like a data conditioning step or amplitude determination, for instance to yield a peak-to-peak value of the wave signal which may be used to look for a low ink condition. Indeed, a variety of different values may be processed and provided as a digitally processed output signal 234. For example, besides the amplitude, other signal conditioning may be performed by the processing portion 216, such as determining the duration of the signal, the phase shift, and the variation of the amplitude of the signal within a sampling time. For instance, the ambient noise may be filtered out to get amplitude data at a specific frequency, which may then be compared to a reference value.

The output signal from the digital signal processing portion 216 is fed to a determining portion 236 of the printer firmware 214. The desired query signal 218 is received by a test conditions and parameters portion 238 of firmware 214. The test conditions and parameters portion 238 communicates bi-diretionally via a signal link 240 with the determination portion 236. Table I shows a variety of different actions that may be queried and determined by these two processors 236, 238. The determine action portion 236 then generates a determined action signal 242, which is supplied to a printer reaction and adjustment portion 244. The printer reaction portion 244 then generates a reaction signal 246, which is fed to the nozzle firing command portion 226. The nozzle firing command portion 226 then adjusts the nozzle firing command signal 228 in response to the reaction signal 246 and the initiate test signal 224 to maintain print quality. The printer reaction portion 244 may also notify the operator of any needed operator intervention. If no adjustments or further queries are needed, then the reaction portion issues a resume signal 252 to a resume printing portion 254, and the printer 20 continues with the normal printing and servicing routines until the desired query 220 is activated again.

For example, if droplet size or volume was being optimized by adjusting the energy applied to the firing resistors, this process may take several iterations. If instead, a low ink condition had been determined by portion 236, then information about this low ink level would be conveyed by signal 242 to the printer reaction portion 244. The reaction portion 244 then generates an alert operator signal 248, which is received by an alert operator portion 250. The operator alert step 250 may be accomplished audibly or visually, for instance by flashing a warning light supported by the printer casing 24, or by displaying a warning message on a computer screen via the host computer.

The desired query may again be performed, if desired, to verify that the correct action has occurred. Upon verifying that the correct adjustment has been made, the desired query portion then remains dormant until another desired query input is received from either the operator, or from a higher level portion of the printer controller 36. For instance, an automatic desired query may be made at the beginning of start up when the printer is initially energized. Alternatively, a desired query of the various nozzle operations may be made at certain intervals, for example daily if a printer is left on continuously, or at the completion of printing a selected number of pages.

E. TABLE 1

Operational Adjustments in Response to Monitoring

| Desired Query (220) | Test Conditions and Parameters (238) | Determine Printer Action (236) |
|---|---|---|
| Pen Characteristics: | | |
| Nozzle Telecentricity | Max./Min. Sig. Direction | Change Firing Sequence |
| Nozzle Directionality | Signal < or > Threshold | Change Firing Sequence |
| Nozzle-to-Nozzle Alignment | Find Maximum Signal | Change Firing Sequence |
| Pen-to-Pen Alignment | Fire to Detect Time | Adjust Carriage/Re-seat |
| Nozzle Operation: | | |
| Clogged Nozzles | No Signai = Clog | Spit/Prime/Wipe |
| Nozzle Damaged | Signai <or > Threshold | Change Dither Pattern and/or Print Pattern |
| Turn-On Energy | Find Minimum Energy for Stable Firing | Adjust Firing Energy |
| Drop Volume or Size | Too Large? Too Small? | Adjust Pulse Width |
| Printer Interface: | | |
| Interconnect Integrity | No Signal = Open Circuit | Clean Pen Interconnect; Re-seat/Replace Pen |
| Media Type Identification | Determine Type | Adjust Drop Size |
| Pen Ink Level: | | |
| Low Ink Detection | Amplitude < Threshold | Signal Operator |
| Out-of-Ink Detection | Amplitude < Threshold | Stop Print Job |

E. Operational Adjustments in Response to Monitoring

The various desired queries, test conditions, parameters, and printer actions are shown in Table I merely for illustration, and other queries may be developed over time, using the inputs provided by monitoring systems 60, 70, 80, 90. The queries 220 are divided into functional groups, with the first group comprising pen characteristics, the second group nozzle operation, the third group printer interface, and the fourth group pen ink level.

(1) Pen Characteristics

In the first group of desired queries 220, the characteristics of nozzle telecentricity, nozzle directionality, nozzle-to-nozzle alignment and pen-to-pen alignment are tested. While all four characteristics may be tested by the printer, testing of the first three characteristics may be more practically implemented during the cartridge manufacturing process.

In a manufacturing context, the monitoring systems 60, 70, 80, and possibly system 90, may be used to determine printhead performance on the assembly line, for instance in quality inspections. In this context, the pen 50 may be installed in a stationary carriage-like mechanism, rather than in the reciprocating carriage 40. Instead of a single sensor, it may be advantageous to use an array of discrete sensors, preferably in a linear array aligned either perpendicular to, or more preferably parallel with the linear arrays of nozzles 106. The linear nozzle arrays 106 are shown parallel to the drawing sheet in FIGS. 2 and 3.

For example, the stationary sensor 75 may be interpreted as representing one sensor in a sensor array running perpendicular with the plane of the drawing sheet of FIG. 3, and thus perpendicular with the nozzle arrays. Conversely, and perhaps more preferably, the stationary sensor 75 may represent one sensor of a sensor array running parallel with the drawing sheet of FIG. 3, and parallel with the nozzle arrays. Of course, in some implementations it may be desirable to partially or completely surround the cartridge with sensors for quality inspection tests. Then, rather than receiving a single digital wave signal 234, the determine action portion 236 receives multiple signals, each generated by one of the discrete sensors in the array. It is apparent that the same function of a sensor array may be accomplished using a single sensor and moving the printhead 54 relative to the sensor (or moving the sensor relative to the printhead) while making multiple drop ejections and pressure wave readings at different locations. The multiple sensor embodiment is preferred because it is faster to use and speeds the assembly and test process, yet the single sensor embodiment may be preferred for use in the printer 20.

Now the various multiple sensor embodiments are understood, more preferably for use in a manufacturing context than in a printer, the manner of testing the first three pen characteristics will be described. First, the term nozzle telecentricity refers to a tilt in the nozzle, that is, when forming the nozzle 106 by laser ablation, the nozzle was not formed perpendicular to the plane of the orifice plate 104. This telecentricity may be detected by using a routine stored in the test conditions portion 238 that determines the direction of the maximum and minimum wave signals emitted by a nozzle 106. Once it is found that a nozzle suffers telecentricity, then the determination portion 236 may decide the action to be taken is to change the nozzle firing sequence, and this information is passed along as signal 242 to the printer reactions and adjustments portion 244. For example, depending upon which nozzle(s) is non-telecentric, and depending upon the direction of the non-telecentricity, then the determination to change the firing sequence may be manifested as a re-mapping of the nozzle firing sequence, or a nozzle substitution may be made.

The second pen characteristic is nozzle directionality, which is similar nozzle telecentricity, but rather than being caused by a misaligned laser, nozzle directionality may be caused by a deformation or blemish at the outlet of the nozzle 106. Such a nozzle blemish may be permanent and caused by damage to the nozzle 106, or it may be temporary, caused by a partial blockage at the nozzle 106. If spitting fails to remedy the directionality, then the system may assume that the nozzle directionality is a permanent deformation. This nozzle directionality may be detected by using threshold values stored in the test parameters portion 238 to determine whether the pressure wave detected in step 202 is less than (<) or greater than (>) these thresholds. Once nozzle directionality is found, then the determination portion 236 may decide the action to be taken is to change the nozzle firing sequence, for example, as described above when for compensating for telecentricity.

The third pen characteristic is nozzle-to-nozzle alignment, where for instance, one nozzle may be located slightly out of alignment with the other nozzles in the array, or it may not be at the desired spacing between adjacent nozzles. This condition may be discovered by using a routine stored in the test conditions portion 238 that looks for the location of the maximum pressure wave by comparing the values received by the discrete sensors in the manufacturing context, or by comparing the values received by a single sensor sampling at different locations relative to the printhead. Once nozzle-to-nozzle misalignment is found, then the determination portion 236 may decide that the action to be taken is to change the nozzle firing sequence, for instance, as described above when for compensating for telecentricity. For example, the nozzles in the two linear arrays are preferably staggered, rather than being directly side-by-side to allow more even ink placement on the page. If one nozzle is mis-located, this defect may show on the printed image as a horizontal colorless band, e.g. as a white stripe when printing on white paper. If the printer is aware of this misalignment, then such a print defect may be hidden or camouflaged by alternately printing with adjacent nozzles in the print pattern, whether in the same array as misaligned nozzle or in the other array.

The fourth pen characteristic is pen-to-pen alignment, where for instance, one cartridge 50, 52 is not properly seated in the carriage 40, or perhaps there is a misalignment in the carriage or pen reference datums used to align the pens with respect to the carriage. Pen-to-pen misalignment may be found using a routine stored in the test conditions portion 238 that finds the time between when firing signal 228 is sent to the firing resistors 112, and when the microphone detects firing in step 202. Alternatively, a routine stored in portion 238 may be used to determine when a maximum pressure wave is monitored, and at that location the nozzle array will be considered to be aligned with respect to the sensor. Examination of pen-to-pen alignment during printer manufacture may be useful to adjust the carriage for proper angular alignment (known in the art as Θ-Z alignment, referring to the degree of rotation about a vertical axis). During printing, pen-to-pen misalignment may be corrected by alerting an operator in step 250 to re-seat the pen in the carriage. If re-seating fails to correct the problem, then the determination portion 236 may decide to change print modes, for instance by adjusting the line feed rate of the print media, or by turning off (or on) certain print mode features, such as the shingling print mode.

(2) Nozzle Operation

The second group of queries 220 concerns nozzle operation, and it includes checks for clogged or damaged nozzles, turn-on energy adjustments, and drop volume or size adjustments.

First, to determine whether any nozzles are clogged, each nozzle may be sequentially fired. When the test conditions portion 238 finds no wave signal is detected, then a clogged nozzle condition exists. The determination portion 236 then determines that a printhead servicing routine needs to be performed. To cure a clogged nozzle, the printhead may be primed if the service station is equipped with a priming mechanism, or the clogged nozzle(s) may be spit in the spittoon 48 (fired when positioned over the spittoon), or a combination of spitting and priming may be used to clear the obstruction.

Second, if upon repeated testing, the nozzle is still appears to be clogged, it may be determined by portion 236 that a permanently damaged nozzle condition exists, and that the firing sequence should be changed to substitute a good nozzle for the permanently damaged one. This may be done by re-mapping the firing sequence, firing timing, etc., for example, as described above with respect to the cures for nozzle telecentricity, directionality, and nozzle-to-nozzle alignment.

Third, to run the printer 20 in a most economical fashion, it is desirable to energize the firing resistor 112 at the lowest energy level at which it will still eject a drop of ink 118, that is, to minimize the turn-on energy. Using a routine stored in the test conditions portion 238, the minimum turn-on energy for a particular nozzle or printhead may be found by initiating a series of nozzle spitting at decreasing power levels, until eventually no droplet is ejected. Then, the immediately preceding energy level may be selected as the minimum turn-on energy, and the action determined by portion 236 is to adjust the firing energy to this value.

Fourth, the monitoring system 60, 70, 80, 90 may also be used to determine drop volume or size. For instance, this may be done by using a routine stored in the test parameters portion 238 to monitor the amplitude of the pressure wave and then determine whether the signal is within threshold limits. When beyond these limits, the determination portion 236 may decide that the pulse width of the firing signal 228 needs to be adjusted to vary the drop volume or size to a desired level.

(3) Printer Interface

The next group of desired queries 220 concerns what may be called printer interface queries, here being illustrated as interconnect integrity and media type identification.

First, in interconnect integrity, the parameter being measured is the electrical connection between the pen and the carriage. Failure to make good electrical contact between the carriage and pen can result in nozzles not firing, since an open circuit condition between the nozzle firing command 226 and the nozzle resistors 112 would fail to energize the resistor so no droplet would be ejected. Upon detecting this condition, an initial instruction 250 to the operator may be to clean the electrical interconnect on the pen where it receives firing signals from the carriage terminals, and/or to re-seat the pen 50, 52 in the carriage 40. If cleaning or re-seating does not cure the problem, then the operator may instructed to replace the pen with a fresh pen. If pen replacement still fails to rectify the problem, then perhaps there is a break in the electrical connection between the carriage 40 and the controller 36, at which point the operator may be asked 250 whether to continue the print job, perhaps using nozzle substitution for the afflicted nozzle, or to cancel the print job and return the printer for servicing.

Second, in media type identification, the type of media in the printzone is determined. This media identification query may be most easily monitored using either the carriage based monitoring system 80, or the printhead system 90, where the sensor 85, 92 is used to listen to the impact of a given size droplet upon the media. For instance, a transparency type media is expected to have a different impact sound than plain paper or a fabric media. The test parameter portion 238 has a routine with certain thresholds corresponding to the various media types. Upon determining the type of media from this droplet landing sound, then the determination portion 236 may decide to adjust the drop size to accommodate the particular media. For instance, transparencies have lower absorbency than paper, and paper has a lesser absorbency than a fabric, so transparencies may receive a smaller drop size, while plain paper, and more particularly fabric, will receive an even larger drop size to accommodate for media absorption of the ink.

(4) Pen Ink Level

The final group of desired queries illustrated concern the ink levels within the cartridges 50, 52. As discussed above, it may be particularly helpful to give an operator an indication of an impending low ink condition, before the pen actually dries out, to allow an operator to purchase a fresh cartridge to have on hand when the cartridge actually empties. Thus, it is also useful to indicate when the cartridge is finally empty. As discussed above with respect to FIG. 6, the wave signal amplitude has been found to decrease as the pen empties of ink. The test parameters portion 238 may have threshold limits stored therein corresponding to certain levels of ink with a cartridge, from full to partially full to empty. Upon passing a selected partially full level, the determine action portion alerts an operator in step 250 that the pen is nearing empty. Upon reaching an out-of-ink condition, the wave signal falls below another threshold, and at that time the determination portion 236 may decide to stop the print job and alert the operator in step 250 so the pen may be replaced or refilled without damaging the printhead.

Conclusion

Thus, a variety of advantages are realized using this monitoring system 60, 70, 80, 90, whether implemented in the audio frequency range or the ultrasonic frequency range. The exact type of sensor being used, whether a microphone, accelerometer, ultrasonic transducer, laser vibrometer, or pressure wave sensor (internal or external to the printhead), as well as the printer design and pen architecture, may require adjustments in the various levels and sampling parameters, etc., illustrated herein, but such adjustments are within the level of those skilled in the art. Moreover, other conditions may be monitored and measured using such a monitoring system, for instance, at some point the system may develop such sophistication that the type of ink being used may be discernible, such as the manufacturers recommended ink composition, or an inferior substitute that may be lacking in print quality. The operator may be alerted in step 250 of these different ink types, and then make a decision as to whether to continue using an inferior ink, or to delay the print job until a pen containing higher quality manufacturers recommended ink is obtained.

Moreover, the test parameters stored in portion 238 may also be varied depending upon various environmental conditions, such as ambient noise levels, print cartridge type, the number of nozzles used in the test, the ambient temperature or humidity, as well as the type of query being made. For instance, a microphone-type sensor may also be used to monitor the ambient noise levels, then using these levels, the controller 36 may adjust the test parameter levels in portion 238 to accommodate the environmental intrudances. Otherwise, the influence of this environmental "static" may be reduced by taking sound samplings over very short time durations.

One advantage of using ultrasonic monitoring over acoustic monitoring is that ultrasonic monitoring is independent of the firing frequency of the printhead. Moreover, ultrasonic monitoring can detect the firing of a single nozzle on the printhead. Additionally, the ultrasonic monitoring system experiences a good signal-to-noise ratio, being relatively immune to contamination from external environmental sound sources. Furthermore, while the concepts described herein are shown for a replaceable inkjet cartridge, it is apparent that these concepts may be extended to printing mechanism having permanent or semi-permanent printheads, such as those which have a stationary ink supply that is fluidicly coupled to the printhead, for instance, by flexible tubing.

The on-board sensor system 90 may be preferred in some implementations because it may be more cost effective to incorporate the sensor directly into the printhead. The illustrated printheads 54' may be manufactured using bulk silicon processes which are inherently less expensive than purchasing discrete sensors 65, 75 and 85. Furthermore, the discrete sensors 65, 75, 85 require separate mounting fixtures 64, 72, 82, as well as separate assembly steps when manufacturing the printer 20, both of which contribute to increased printer cost. The on-board sensor 92 uses the existing communication pathways between the carriage 40 and the printer controller 36 which are used to communicate the firing signals to the firing resistors 112, as well as to provide printhead temperature sensor feedback to the controller 36.

Moreover, using an array of external sensors the printhead nozzles may be checked during manufacture on the assembly line for printhead quality assurance checks, such as to look for nozzle directionality, nozzle-to-nozzle alignment, nozzle telecentricity, ink trajectory, etc. For example, by looking for the highest wave signal generated by such multiple sensors, it is possible to determine a nozzle trajectory error. In an advanced printhead/printing mechanism combination, this printhead performance information may be recorded on an electronic integrated circuit on-board the cartridge 50, 52 for later reading by the printer controller 36, which in response thereto adjusts the print modes or firing sequence accordingly to mask the nozzle defect. For example, this information may be stored in a ROM (read only memory) or other equivalent storage device on-board the cartridge, which for example, may be incorporated into the silicon substrate 110, or in communication with the substrate. Such an advanced system leads to less printheads being rejected during manufacture, which lowers the scrap rate and the associated waste overhead, yielding a lower manufacturing cost that can easily be passed along to consumers in the form of lower cost cartridges.

We claim:

1. An inkjet printing mechanism, comprising:

a frame;

an inkjet printhead supported by the frame and having plural nozzles that each normally, in response to an enabling signal, eject ink therethrough and generate an ultrasonic pressure wave having ultrasonic frequency components;

an ultrasonic pressure wave sensor supported by the frame to detect the ultrasonic pressure wave and generate a wave signal in response thereto; and a controller which responds to the wave signal by generating an action signal.

2. An inkjet printing mechanism according to claim 1 wherein the sensor comprises an accelerometer.

3. An inkjet printing mechanism according to claim 1 wherein the sensor comprises an ultrasonic microphone.

4. An inkjet printing mechanism according to claim 1 wherein:

the printing mechanism further includes a spittoon portion to receive ink ejected from the plural nozzles during purging; and the sensor is located at the spittoon to detect ink ejected from the plural nozzles during purging.

5. An inkjet printing mechanism according to claim 1 wherein:

the printing mechanism further includes a chassis; and the sensor is supported by the chassis.

6. An inkjet printing mechanism according to claim 1 wherein:

the printing mechanism further includes a carriage;

the inkjet printhead is supported by the carriage; and the sensor is supported by the carriage.

7. An inkjet printing mechanism according to claim 1 wherein the sensor is located at the inkjet printhead.

8. An inkjet printing mechanism according to claim 7 wherein the sensor is integrally formed with the inkjet printhead.

9. An inkjet printing mechanism according to claim 8 wherein the sensor comprises an accelerometer.

10. An inkjet printing mechanism according to claim 7 wherein the controller is also responsive to a desired query signal, and the action signal is also generated in response to the desired query signal.

11. An apparatus for printing in an inkjet printing mechanism that generates plural firing signals, comprising:

an ink reservoir holding a supply of ink;

an orifice plate defining plural nozzles extending therethrough;

an ink ejection mechanism which fluidicly couples ink reservoir to the orifice plate nozzles, with the ink ejection mechanism comprising plural ink ejection chambers each responsive to at least one of the plural firing signals to normally eject ink through an associated one of the plural nozzles; and a sensor located between the ink reservoir and he orifice plate to detect a pressure wave normally generated in response to at least one of the plural firing signals, and to generate a wave signal in response thereto.

12. An apparatus according to claim 11 wherein the ink ejection mechanism comprises a thermal ink ejection mechanism.

13. An apparatus according to claim 11 wherein the sensor comprises an accelerometer mechanism.

14. An apparatus according to claim 13 wherein the accelerometer mechanism comprises a cantilevered reed member.

15. An apparatus according to claim 14 further including a structure which defines a resonance chamber, wherein the reed member of the accelerometer mechanism extends into the resonance chamber.

16. An apparatus according to claim 15 wherein the resonance chamber is enclosed to isolate the reed member from the ink.

17. An apparatus according to claim 15 wherein the Teed member is centrally located within the resonance chamber.

18. An apparatus according to claim 15 wherein the ink ejection mechanism includes a substrate layer connected with the orifice plate to define the resonance chamber between the substrate layer and the orifice plate.

19. An apparatus according to claim 18 wherein:

the ink ejection mechanism includes a barrier layer having opposing first and second sides, with the first side of the barrier layer bonded to the orifice plate; and a portion of the reed member is sandwiched between the substrate layer and the second side of the barrier layer.

20. An apparatus according to claim 18 wherein:

the substrate layer has a first surface which comprises a portion of said structure defining the resonance chamber; and the ink ejection mechanism includes plural firing resistors supported by the first surface of the substrate layer, with each firing resistor associated with at least one of the plural ink ejection chambers and responsive to at least one of the plural firing signals.

21. An apparatus according to claim 18 wherein:

the substrate layer has a first surface with a land portion adjacent a concave portion;

the concave portion of the first surface comprises a portion of said structure which defines the resonance chamber; and the land portion of the first surface cooperates with the orifice plate to define the plural ink ejection chambers.

22. An apparatus according to claim 21 wherein the ink ejection mechanism includes plural firing resistors each supported by the land portion of the substrate layer, with each firing resistor associated with at least one of the plural ink ejection chambers and responsive to at least one of the plural firing signals.

23. An apparatus according to claim 14 wherein the reed member is tuned to a specific frequency.

24. An apparatus according to claim 23 wherein the reed member is tuned to an audible acoustic frequency.

25. An apparatus according to claim 23 wherein:

the inkjet printing mechanism generates plural firing signals at a firing frequency; and the reed member is tuned to a frequency corresponding to the firing frequency or to harmonics of the firing frequency.

26. An apparatus according to claim 23 wherein the reed member is tuned to an ultrasonic frequency.

27. An apparatus according to claim 13 wherein the accelerometer mechanism comprises plural cantilevered reed members.

28. An apparatus according to claim 27 further including a structure which defines a resonance chamber, wherein the plural cantilevered reed members extend into the resonance chamber.

29. An apparatus according to claim 28 wherein the plural cantilevered reed members are dispersed throughout the resonance chamber.

30. An apparatus according to claim 28 wherein the plural cantilevered reed members are clustered in a group in the resonance chamber.

31. An apparatus according to claim 28 wherein the plural cantilevered reed members are clustered in plural groups in the resonance chamber.

32. An apparatus according to claim 13 further including a structure which defines an elongated resonance chamber having opposing first and second end regions, wherein the accelerometer mechanism comprises plural cantilevered reed members which extend into the resonance chamber, with at least one reed member located in the first end region, and at least one reed member located in the second end region.

33. An apparatus according to claim 13 wherein the accelerometer mechanism comprises plural cantilevered reed members, wherein at least two of the plural cantilevered reed members are tuned to different frequencies.

* * * * *

UNITED STATES PATENT AND TRADEMARK OFFICE

CERTIFICATE OF CORRECTION

PATENT NO. : 6,260,941 B1
DATED : July 17, 2001
INVENTOR(S) : Su et al.

It is certified that error appears in the above-identified patent and that said Letters Patent is hereby corrected as shown below:

Title page,
Item [54], Title, delete the title "ACOUSTIC AND ULTRASONIC MONITORING OF INKJET DROPLETS" and insert therefor -- PRESSURE WAVE MONITORING OF INKJET DROPLETS --.

Column 26,
Line 17, delete "claim 7" and insert therefor -- claim 1 --.
Line 26, after "couples", insert -- the --
Line 33, delete "he" and insert therefor -- the --.
Line 52, delete Teed" and insert therefor -- reed --.

Signed and Sealed this

Twelfth Day of November, 2002

*Attest:*

*Attesting Officer*

JAMES E. ROGAN
*Director of the United States Patent and Trademark Office*